US005491057A

United States Patent [19]

Hioki

[11] Patent Number: 5,491,057

[45] **Date of Patent: *Feb. 13, 1996**

[54] SILVER HALIDE EMULSION

[75] Inventor: Takanori Hioki, Kanagawa, Japan

[73] Assignee: Fuji Photo Film Co., Ltd., Kanagawa, Japan

[ * ] Notice: The term of this patent shall not extend beyond the expiration date of Pat. No. 5,489,920.

[21] Appl. No.: 348,767

[22] Filed: Dec. 2, 1994

Related U.S. Application Data

[63] Continuation of Ser. No. 923,527, Aug. 3, 1992, abandoned.

[30] Foreign Application Priority Data

Aug. 14, 1991 [JP] Japan ..... 3-228625

[51] Int. Cl.[6] ..... G03C 1/12

[52] U.S. Cl. ..... 430/584; 430/577; 430/578; 430/579; 430/583; 430/585; 430/944

[58] Field of Search ..... 430/583, 584, 430/585, 578, 577, 579, 944

[56] References Cited

U.S. PATENT DOCUMENTS

| | | | |
|---|---|---|---|
| 2,481,464 | 9/1949 | Anish . | |
| 3,541,089 | 11/1970 | Heseltine et al. . | |
| 3,622,317 | 11/1971 | Bird et al. . | |
| 4,536,473 | 8/1985 | Mihara . | |
| 5,223,389 | 6/1993 | Matsunaga | 430/584 |

FOREIGN PATENT DOCUMENTS

| | | |
|---|---|---|
| 0123983 | 11/1984 | European Pat. Off. . |
| 0256858 | 2/1988 | European Pat. Off. . |
| 70503 | 12/1958 | France . |
| 1008573 | 12/1954 | Germany . |
| 592267 | 9/1947 | United Kingdom . |
| 1153344 | 5/1969 | United Kingdom . |

*Primary Examiner*—Thorl Chea
*Attorney, Agent, or Firm*—Sughrue, Mion, Zinn, Macpeak & Seas

[57] ABSTRACT

Disclosed is a silver halide emulsion having at least one methine compound of formula (I) $(MET)_{k1}$—$[(Q)$ —$Ar]_{k2}$, wherein MET represents an atomic group having a methine compound structure; Q represents a divalent linking group composed of atom(s) or atomic group(s) containing at least one carbon, nitrogen, sulfur or oxygen atom; Ar represents an aromatic group containing monocyclic compound(s) each composed of 5 or more atoms; k1 represents an integer of 1 or more; and k2 represents an integer of 2 or more. A photographic material containing the emulsion has high sensitivity and high storage stability.

12 Claims, No Drawings

SILVER HALIDE EMULSION

This is a continuation of application Ser. No. 07/923,527 filed Aug. 3, 1992, now abandoned.

FIELD OF THE INVENTION

The present invention relates to a silver halide emulsion containing novel methine compound(s). More precisely, it relates to a silver halide emulsion which is free from fluctuation of sensitivity under spontaneous storage.

BACKGROUND OF THE INVENTION

Hitherto, a technology of adding sensitizing dye(s) to a silver halide emulsion to enlarge the sensitive wavelength range of the emulsion, so as to optically sensitize it, has been well known in the field of silver halide photographic materials.

Many compounds have heretofore been known as color sensitizing dyes to be used for this purpose, for instance, the cyanine dyes, merocyanine dyes, xanthene dyes and others described in T. H. James, *The Theory of the Photographic Process,* 3rd Ed., 1966 (published by Macmillan Co., New York), pages 198 to 228.

Where such sensitizing dyes are applied to silver halide emulsions, in general, they must not merely enlarge the sensitive wavelength range of the silver halide emulsions but also must satisfy the following conditions:

(1) they have a suitable color-sensitizing range;

(2) they have a high sensitizing efficiency and may yield a sufficiently high sensitivity;

(3) they do not cause fogging;

(4) they may sensitize silver halide emulsions in such a way that the sensitivity of the sensitized emulsion does not fluctuate much under variation of the ambient temperature during exposure;

(5) they do not have any bad interaction with other additives such as stabilizers, antifoggant, coating aids and couplers;

(6) where silver halide emulsions to which sensitizing dyes have been added are stored, the sensitivity of the emulsions does not fluctuate; in particular, where they are stored under high temperature and high humidity conditions, they are free from fluctuation in the sensitivity thereof; and (7) the sensitizing dyes added to silver halide emulsions do not diffuse into any other light-sensitive layers to cause color mixing after development.

The above-mentioned conditions are important in preparing silver halide emulsions for silver halide photographic materials.

However, despite of various trials and attempts, lowering of the sensitivity of raw films during their storage could not be prevented to a satisfactory degree.

SUMMARY OF THE INVENTION

An object of the present invention is to provide a high-sensitivity silver halide photographic material which is hardly fogged, and the sensitivity of which is hardly lowered, during storage thereof under high temperature and/or high humidity conditions, or to provide a high-sensitivity silver halide photographic material having excellent raw film storability.

These and other objects of the present invention have been attained by a silver halide emulsion containing at least one compound of general formula (I):

$$(MET)_{k1}—[(Q)—Ar]_{k2} \quad (I)$$

wherein MET represents an atomic group having a methine compound structure; Q represents a divalent linking group composed of atom(s) or atomic group(s) containing at least one carbon, nitrogen, sulfur or oxygen atom; Ar represents an aromatic group containing monocyclic compound(s) each composed of 5 or more atoms; k1 represents an integer of 1 or more; and k2 represents an integer of 2 or more.

In one preferred embodiment of the present invention, the oxidation potential of the methine dyes of formula (I) is 0.60 (VvsSCE) or less, more preferably, it is 0.45 (VvsSCE) or less.

In another preferred embodiment of the present invention, MET is an atomic group having a hexamethinemerocyanine structure or a heptamethine-cyanine structure.

DETAILED DESCRIPTION OF THE INVENTION

The present invention will be explained in more detail hereunder.

In formula (I), the group represented by MET has a cyanine structure in which a nitrogen-containing hetero ring which is generally called a basic nucleus is linked to another nitrogen-containing hetero ring via a conjugated double bond so that both rings may be conjugated to each other, or a merocyanine structure in which a hetero ring which is called an acidic nucleus is linked to a basic nucleus via a conjugated double bond so that the carbonyl group of the acidic nucleus and the nitrogen atom in the basic nucleus may be conjugated to each other, or a rhodacyanine structure having these structures, or has an oxonole structure, a hemicyanine structure, a styryl structure or a benzylidene structure.

Examples of such polymethine dyes are described in, for example, T. H. James, *The Theory of the Photographic Process,* 1977 (published by Macmillan Co.), Chap. 8; and D. M. Sturmer, *The Chemistry of Heterocyclic Compounds,* 1977 (edited by A. Weissberger and E. C. Taylor, published by John Wiley and Sons, New York).

Q represents a divalent linking group composed of atom(s) or atomic group(s) containing at least one carbon, nitrogen, sulfur or oxygen atom.

Preferably, Q is a divalent linking group having 20 or less carbon atoms, which is composed of one or more of an alkylene group (e.g., methylene, ethylene, propylene, butylene, pentylene), an arylene group (e.g., phenylene, naphthylene), an alkenylene group (e.g., ethenylene, propenylene), a sulfonyl group, a sulfinyl group, a thioether group, an ether group, a carbonyl group, a group of —N($R^1$)— (where $R^1$ is a hydrogen atom, a substituted or unsubstituted alkyl group, or a substituted or unsubstituted aryl group), and a heterocyclic divalent group (e.g., 6-chloro-1,3,5-triazine-2,4-diyl, pyrimidine-2,4-diyl, quinoxaline-2,3-diyl). More preferably, it is composed of ether group(s) and alkylene group(s).

k1 represents an integer of 1 or more; and k2 represents an integer of 2 or more.

As k1 , preferred is 1 or 2; and as k2, preferred is 2, 3, 4 or 5. As k1 , more preferred is 1; and as k2, more preferred is 3 or 4.

The term Ar is described below. The definition of "aromatic property" for Ar is described in, for example, F.

Tamamushi, Iwanami's Encyclopaedia for physics and chemistry (published by Iwanami Publishing Co., 1981), pages 1258 to 1259.

Specific examples of monocyclic compounds to be in Ar are shown below:

(Ar-1)

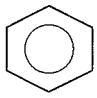

(Ar-2)

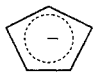

(Ar-3)

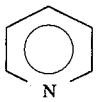

(Ar-4)

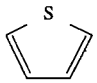

(Ar-5)

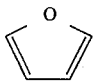

(Ar-6)

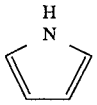

(Ar-7)

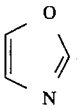

(Ar-8)

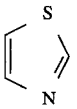

(Ar-9)

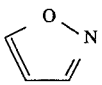

(Ar-10)

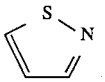

(Ar-11)

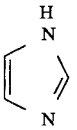

(Ar-12)

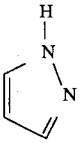

(Ar-13)

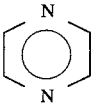

-continued (Ar-14)

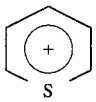

Of them, preferred are (Ar-1) and (Ar-3).

These monocyclic compounds of Ar may be substituted. Preferred substituents include a hydrogen atom, a substituted or unsubstituted alkyl group (e.g., methyl, ethyl, propyl, butyl, hydroxyethyl, trifluoromethyl, benzyl, sulfopropyl, diethylaminoethyl, cyanopropyl, adamantyl, p-chlorophenethyl, ethoxyethyl, ethylthioethyl, phenoxyethyl, carbamoylethyl, carboxyethyl, ethoxycarbonylmethyl, acetylaminoethyl), a substituted or unsubstituted alkenyl (e.g., allyl, styryl), a substituted or unsubstituted aryl (e.g., phenyl, naphthyl, p-carboxyphenyl, 3,5-dicarboxyphenyl, m-sulfophenyl, p-acetamidophenyl, 3-caprylamidophenyl, p-sulfamoylphenyl, m-hydroxyphenyl, p-nitrophenyl, 3,5-dichlorophenyl, p-anisyl, o-anisyl, p-cyanophenyl, p-N-methylureidophenyl, m-fluorophenyl, p-tolyl, m-tolyl), an optionally substituted heterocyclic group (e.g., pyridyl, 5-methyl-2-pyridyl, thienyl), a halogen atom (e.g., chlorine, bromine, fluorine), a mercapto group, a cyano group, a carboxyl group, a sulfo group, a hydroxy group, a carbamoyl group, a sulfamoyl group, an amino group, a nitro group, an optionally substituted alkoxy group (e.g., methoxy, ethoxy, 2-methoxyethoxy, 2-phenylethoxy), an optionally substituted aryloxy group (e.g., phenoxy, p-methylphenoxy, p-chlorophenoxy), an acyl group (e.g., acetyl, benzoyl), an acylamino group (e.g., acetylamino, caproylamino), a sulfonyl group (e.g., methanesulfonyl, benzenesulfonyl), a sulfonylamino group (e.g., methanesulfonylamino, benzenesulfonylamino), a substituted amino group (e.g., diethylamino, hydroxyamino), an alkyl or arylthio group (e.g., methylthio, carboxyethylthio, sulfobutylthio, phenylthio), an alkoxycarbonyl group (e.g., methoxycarbonyl), and an aryloxycarbonyl group (e.g., phenoxycarbonyl). These substituents may be bonded to MET via a divalent linking group Q or a single bond.

These substituents may have their own substituent(s) selected from an alkyl group, an alkenyl group, an aryl group, a hydroxy group, a carboxy group, a sulfo group, a nitro group, a cyano group, a halogen atom, an alkoxy group, an aryloxy group, an alkoxycarbonyl group, an acyl group, an acylamino group, a sulfonamino group, a carbamoyl group, a sulfamoyl group, etc.

At least one of these substituents may be bonded to MET via a divalent linking group Q or a single bond. Ar is bonded to (Q)-$(MET)_{k1}$ via at least one substituent or a single bond.

Measurement of the oxidation potential of the methine compounds of formula (I) is effected by phase differentiating secondary higher harmonics alternating current polarography, which is described in detail hereunder.

The solvent used is acetonitrile (spectrum grade) dried in 4A-1/16 Molecular Sieves; and the supporting electrolyte used is normal-tetrapropylammonium perchlorate (special reagent for polarography). A sample solution is prepared by dissolving from $10^{-3}$ to $10^{-5}$ mol/liter of a red-sensitizing dye in acetonitrile containing 0.1M supporting electrolyte. Prior to measurement, the sample solution is disoxidated with a high-purity argon gas (99.999%) passed through a high-alkaline aqueous solution of pyrogallol and then through calcium chloride, for 15 minutes or more. The working electrode used is a rotary platinum electrode; the reference electrode used is a saturated calomel electrode (SCE); and the counter electrode used is platinum.

The reference electrode and the sample solution are connected with each other via a Luggin tube filled with acetonitrile containing 0.1M supporting electrolyte; and Vycor glass is used for liquid-junction. The top of the Luggin tube and the top of the rotary platinum electrode are separated from each other with a space of from 5 mm to 8 mm therebetween, and measurement is effected at 25° C. under the condition.

The above-described measurement of oxidation potential by phase differentiating secondary higher harmonics alternating current voltammetry is described in Journal of Imaging Science, Vol. 30, pages 27 to 35 (1986).

Preferably, MET has a hexamethine-merocyanine structure of the following general formula (II) or a heptamethinecyanine structure of the following general formula (III):

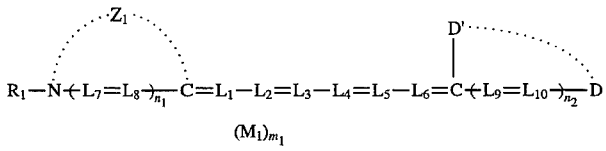

(II)

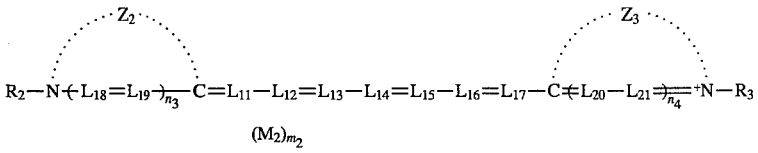

(III)

wherein $Z_1$, $Z_2$ and $Z_3$ each represents an atomic group necessary for forming a 5-membered or 6-membered nitrogen-containing hetero ring;

the dotted line between D and D' groups may or may not indicate that those groups are linked;

D and D' each represents an atomic group necessary for forming a non-cyclic or cyclic acidic nucleus;

$R_1$, $R_2$ and $R_3$ each represents an alkyl group;

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$ and $L_{21}$ each represents a methine group or a substituted methine group and may form a ring together with other methine group(s) or may form a ring together with auxochrome(s);

$n_1$, $n_2$, $n_3$ and $n_4$ each represents 0 or 1;

$M_1$ and $M_2$ each represents a charge-neutralizing pair ion; and $m_1$ and $m_2$ each represents a number of 0 or more which is necessary for neutralizing the charge in the molecule.

MET represented by formula (II) or (III) is substituted by at least two Ar groups via the divalent linking group Q.

Structure of formulae (II) and (III) will be described in more detail hereunder.

Preferably, $R^1$, $R_2$ and $R_3$ each is an unsubstituted alkyl group having 18 or less carbon atoms (e.g., methyl, ethyl, propyl, butyl, pentyl, octyl, decyl, dodecyl, octadecyl), or a substituted alkyl group. The substituted alkyl group preferably has 18 or less carbon atoms in the alkyl moiety and may be substituted, for example, by one or more substituents selected from a carboxyl group, a sulfo group, a cyano group, a halogen atom (e.g., fluorine, chlorine, bromine), a hydroxyl group, an alkoxycarbonyl group having 8 or less carbon atoms (e.g., methoxycarbonyl, ethoxycarbonyl, phenoxycarbonyl, benzyloxycarbonyl), an alkoxy group having 8 or less carbon atoms (e.g., methoxy, ethoxy, benzyloxy, phenethyloxy), a monocyclic aryloxy group having 10 or less carbon atoms (e.g., phenoxy, p-tolyloxy), an acyloxy group having 3 or less carbon atoms (e.g., acetyloxy, propionyloxy), an acyl group having 8 or less carbon atoms (e.g., acetyl, propionyl, benzoyl, mesyl), a carbamoyl group (e.g., unsubstituted carbamoyl, N,N-dimethylcarbamoyl, morpholinocarbonyl, piperidinocarbonyl), a sulfamoyl group (e.g., unsubstituted sulfamoyl, N,N-dimethylsulfamoyl, morpholinosulfonyl, piperidinosulfonyl), and an aryl group having 10 or less carbon atoms (e.g., phenyl, 4-chlorophenyl, 4-methylphenyl, α-naphthyl). More preferably, $R_1$, $R_2$ and $R_3$ each is an unsubstituted alkyl group (e.g., methyl, ethyl, n-propyl, n-butyl, n-pentyl, n-hexyl), a carboxyalkyl group (e.g., 2-carboxyethyl, carboxymethyl), or a sulfoalkyl group (e.g., 2-sulfoethyl, 3-sulfopropyl, 4-sulfobutyl, 3-sulfobutyl).

$(M_1)_{m_1}$ and $(M_2)_{m_2}$ each indicates the presence or absence of cation(s)" or anion(s), when they are needed to neutralize the ionic charge of the dye. Whether the dye is cationic or anionic or whether it has net ionic charge(s) depends upon the auxochrome(s) and substituent(s) therein. Typical cations are inorganic or organic ammonium ions and alkali metal ions, while the anions may be any of the inorganic anions or organic anions. For instance, the anions may be halide anions (e.g., fluoride ion, chloride ion, bromide ion, iodide ion), substituted arylsulfonate ions (e.g., p-toluenesulfonate ion, p-chlorobenzenesulfonate ion), aryldisulfonate ions (e.g., 1,3-benzenedisulfonate ion, 1,5-naphthalenedisulfonate ion, 2,6-naphthalenedisulfonate ion), alkylsulfate ions (e.g., methylsulfate ion), sulfate ions, thiocyanate ions, perchlorate ions, tetrafluoroborate ions, picrate ions, acetate ions, and trifluoromethanesulfonate ions.

Preferred are ammonium ion, iodide ion and p-toluenesulfonate ion.

Examples of the nuclei formed by $Z_1$, $Z_2$ or $Z_3$ include thiazole nuclei {e.g., thiazole nuclei (such as thiazole, 4-methylthiazole, 4-phenylthiazole, 4,5-dimethylthiazole, 4,5-diphenylthiazole), benzothiazole nuclei (such as benzothiazole, 4-chlorobenzothiazole, 5-chlorobenzothiazole, 6-chlorobenzothiazole, 5-nitrobenzothiazole, 4-methylbenzothiazole, 5-methylthiobenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 6-methylthiobenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5,6-dimethylthiobenzothiazole, 5,6-dimethoxybenzothiazole, 5-hydroxy-6-methylbenzothiazole, tetrahydrobenzothiazole, 4-phenylbenzothiazole), naphthothiazole nuclei (such as naphtho[2,1-d]thiazole, naphtho[ 1,2-d]thiazole, naphtho[2,3-d]thiazole, 5-methoxynaphtho[ 1,2-d]thiazole, 7-ethoxynaphtho[2,1-d] thiazole, 8-methoxynaphtho[ 2,1-d]thiazole, 5-methoxynaphtho[2,3-d]-thiazole)}, thiazoline nuclei (e.g., thiazoline, 4-methylthiazoline, 4-nitrothiazoline), oxazole nuclei (e.g., oxazole nuclei (such as oxazole, 4-methyloxazole, 4-nitroxazole, 5-methyloxazole, 4-phenyloxazole, 4,5-diphenyloxazole, 4-ethyloxazole), benzoxazole nuclei (such as benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole), naphthoxazole nuclei (such as naphtho[2,1-d] oxazole, naphtho[1,2-d]oxazole, naphtho[2,3-d] oxazole, 5-nitronaphtho[2,1-d]oxazole)}, oxazoline nuclei (e.g., 4,4-dimethyloxazoline), selenazole nuclei {e.g., selenazole nuclei (such as 4-methylselenazole, 4-nitroselenazole, 4-phenylselenazole), benzoselenazole nuclei (such as benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, 5,6-dimethylbenzoselenazole), naphthoselenazole nuclei (such as naphtho[2,1-d]selenazole, naphtho[1,2-d]selenazole)}, selenazoline nuclei (e.g., selenazoline, 4-methylselenazoline ), tellurazole nuclei {e.g., tellurazole nuclei (such as tellurazole, 4-methyltellurazole, 4-phenyltellurazole), benzotellurazole nuclei (such as benzotellurazole, 5-chlorobenzotellurazole, 5-methylbenzotellurazole, 5,6-dimethylbenzotellurazole, 6-methoxybenzotellurazole), naphthotellurazole nuclei (such as naphtho [2,1-d]tellurazole, naphtho[1,2-d]tellurazole)}, tellurazoline nuclei (e.g., tellurazoline, 4-methyltellurazoline), 3,3-dialkylindolenine nuclei (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-di-methyl- 5-methoxyindolenine, 3,3,5-trimethylindolenine, 3,3-dimethyl-5-chloroindolenine), imidazole nuclei {e.g., imidazole nuclei (such as 1-alkylimidazole, 1-alkyl-4-phenylimidazole, 1-arylimidazole), benzimidazoles (such as 1-alkylbenzimidazole, 1-alkyl-5-chlorobenzimidazole, 1-alkyl- 5,6-dichlorobenzimidazole, 1-alkyl-5-metoxybenzimidazole, 1-alkyl-5-cyanobenzimidazole, 1-alkyl-5-fluorobenzimidazole, 1-alkyl-5-trifluoromethylbenzimidazole, 1-alkyl- 6-chloro-5-cyanobenzimidazole, 1-alkyl-6-chloro-5-trifluoromethylbenzimidazole, 1-allyl-5,6-dichlorobenzimidazole, 1-allyl-5-chlorobenzimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole), naphthoimidazole nuclei (such as 1-alkylnaphtho[ 1,2-d]imidazole, 1-arylnaphtho[1, 2-d]imidazole, in which the alkyl moiety preferably has from 1 to 8 carbon atoms and is, for example, an unsubstituted alkyl group such as methyl, ethyl, propyl, isopropyl or butyl, or a hydroxyalkyl group such as 2-hydroxyethyl or 3-hydroxypropyl, and it is especially preferably a methyl or ethyl group, and the aryl moiety is preferably a phenyl group, a halogen-substituted phenyl group such as chloro-substituted phenyl, an alkyl-substituted phenyl group such as methyl-substituted phenyl, or an alkoxy-substituted phenyl group such as methoxy-substituted phenyl}, pyridine nuclei (e.g., 2-pyridine, 4-pyridine, 5-methyl-2-pyridine, 3-methyl-4-pyridine), quinoline nuclei {e.g., quinoline nuclei (such as 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4quinoline, 8-fluoro-4-quinoline, 8-methyl-4-quinoline, 8-methoxy-4-quinoline, 6-methyl-4-quinoline, 6-methoxy-4-quinoline, 6-chloro-4-quinoline), isoquinoline nuclei (such as 6-nitro-1-isoquinoline, 3,4-dihydro-1-isoquinoline, 6-nitro-3-isoquinoline)}, imidazo[4,5-b]quinoxaline nuclei (e.g., 1,3-diethylimidazo[4,5-b]quinoxaline, 6-chloro- 1,3-diallylimidazo[4,5-b]quinoxaline), oxadiazole nuclei, thiadiazole nuclei, tetrazole nuclei, and pyrimidine nuclei.

Preferred nuclei formed by $Z_1$, $Z_2$ and $Z_3$ are benzothiazole nuclei, naphthothiazole nuclei, benzoxazole nuclei, naphthoxazole nuclei, benzimidazole nuclei, 2-quinoline nuclei, and 4-quinoline nuclei.

D and D' represent atomic groups necessary for forming an acidic nucleus, which may be any form of acidic nuclei of merocyanine dyes. Preferably, D is a thiocarbonyl group or a carbonyl group; and D' is the remaining atomic group necessary for forming an acidic nucleus D and D' may together form a 5-membered or 6-membered heterocyclic group composed of carbon, nitrogen and chalcogen (typically, oxygen, sulfur, selenium and tellurium) atoms. Preferably, they complete one of the following nuclei: 2-pyrazolin-5-one, pyrazolidine-3,5-dione, imidazolin-5-one, hydantoin, 2- or 4-thiohydantoin, 2-iminoxazolidin-4-one, 2-oxazolin-5-one, 2-thioxazolidine- 2,4-dione, isoxazolin-5-one, 2-thiazolin-4-one, thiazolidin-4-one, thiazolidine-2,4-dione, rhodanine, thiazolidine-2,4-dione, isorhodanine, indane-1,3-dione, thiophen-3-one, thiophen-3-one-1,1-dioxide, indolin-2-one, indolin-3-one, indazolin-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinolin-4-one, 1,3-dioxane-4,6-dione, barbituric acid, 2-thiobarbituric acid, chromane-2,4-dione, indazolin-2-one, and pyrido[1,2-a] pyrimidine-1,3-dione.

Of them, preferred are nuclei of 3-alkylrhodanine, 3-alkyl-2-thioxazolidine-2,4-dione, and 3-alkyl-2-thiohydantoin.

These nuclei may be substituted on the nitrogen atom(s) contained therein. Preferred substituents to them include, for example, a hydrogen atom, an alkyl group having from 1 to 18, preferably from 1 to 7, more preferably from 1 to 4, carbon atoms (e.g., methyl, ethyl, propyl, isopropyl, butyl, isobutyl, hexyl, octyl, dodecyl, octadecyl), a substituted alkyl group (e.g., aralkyl group (such as benzyl, 2-phenylethyl), a hydroxyalkyl group (such as 2-hydroxyethyl, 3-hydroxypropyl), a carboxyalkyl group (such as 2-carboxyethyl, 3-carboxypropyl, 4-carboxybutyl, carboxymethyl), an alkoxyalkyl group (such as 2-methoxyethyl, 2-(2-methoxyethoxy)ethyl), a sulfoalkyl group (such as 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl), a sulfatoalkyl group (such as 3-sulfatopropyl, 4-sulfatobutyl), a heterocyclic group-substituted alkyl group (such as 2-(pyrrolidin-2-on- 1-yl)ethyl, tetrahydrofurfuryl, 2-morpholinoethyl, 2-acetoxyethyl, carbomethoxymethyl, 2-methanesulfonylaminoethyl}, an allyl group, an aryl group (e.g., phenyl, 2-naphthyl), a substituted aryl group (e.g., 4-carboxyphenyl, 4-sulfophenyl, 3-chlorophenyl, 3-methylphenyl), and a heterocyclic group (e.g., 2-pyridyl, 2-thiazolyl).

More preferred are an unsubstituted alkyl group (e.g., methyl, ethyl, n-propyl, n-butyl, n-pentyl, n-hexyl), a carboxyalkyl group (e.g., carboxymethyl, 2-carboxyethyl, sulfoalkyl such as 2-sulfoethyl).

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$ and $L_{21}$ each represents a methine group or a substituted methine group, for example, substituted by one or more substituents selected from a substituted or unsubstituted alkyl group (e.g., methyl, ethyl, 2-carboxyethyl), a substituted or unsubstituted aryl group (e.g., phenyl, o-carboxyphenyl), a heterocyclic group (e.g., barbituric acid), a halogen atom (e.g., chlorine, bromine), an alkoxy group (e.g., methoxy, ethoxy), an amino group (e.g., N,N-diphenylamino, N-methyl-N-phenylamino, N-methylpiperazino) and an alkylthio group (e.g., methylthio, ethylthio). They each may form a ring together with other methine group(s) or may form a ring together with auxochrome(s).

Preferably, at least one combination of $L_2$ and $L_4$, $L_3$ and $L_5$, and $L_4$ and $L_6$ forms a ring. Also preferably, at least one combination of $L_{12}$ and $L_{14}$, $L_{13}$ and $L_{15}$, and $L_{14}$ and $L_{16}$ forms a ring.

Especially preferred ring structures as combinations of $L_2$ and $L_4$, $L_4$ and $L_6$, $L_{12}$ and $L_{14}$, and $L_{14}$ and $L_{16}$ are shown below:

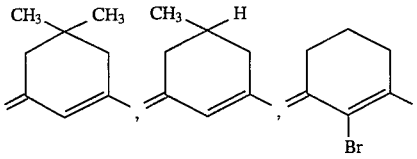

Especially preferred ring structures as combinations of $L_3$ and $L_5$, and $L_{13}$ and $L_{15}$ are shown below:

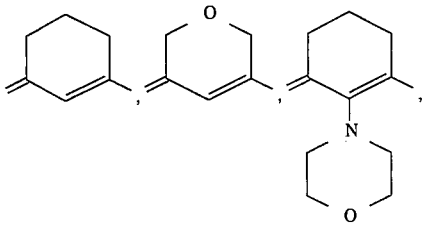

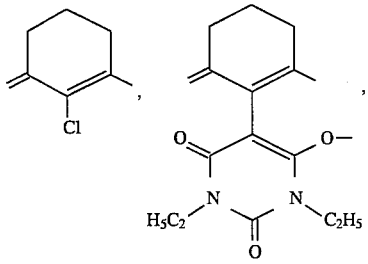

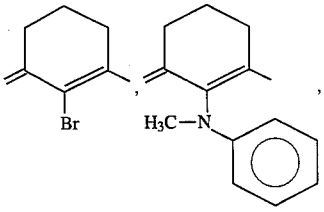

-continued

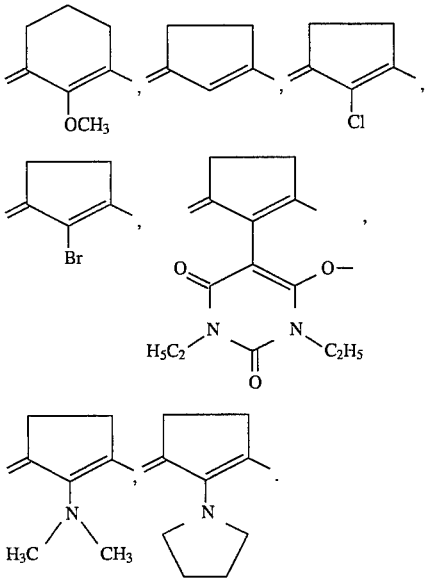

Where $L_3$ and $L_5$, and $L_{13}$ and $L_{15}$ each form a ring structure, then $L_4$ and $L_{14}$, respectively, are each preferably an unsubstituted methine group, or a methine group substituted by one or more substituents selected from an unsubstituted alkyl group (e.g., methyl), an alkoxy group (e.g., methoxy), an amino group (e.g., N,N-diphenylamino) and a halogen atom (e.g., chlorine), or a methine group substituted by one or more acidic nuclei, such as those of the above-mentioned D and D'.

The other L groups are preferably unsubstituted methine groups.

The compounds of formulae (II) and (III) are each substituted by at least two [—(Q)—Ar] groups; and the substitution positions in the formulae may be, for example, any of the 5-membered or 6-membered nitrogen-containing rings represented by $Z_1$, $Z_2$ or $Z_3$, or the acidic nucleus represented by D or D', or the alkyl group represented by $R_1$, $R_2$ or $R_3$, or the methine group represented by any of $L_1$ to $L_{21}$.

Preferably, the substituent [—(Q)—Ar] groups are substituted to any of $R_1$, $R_2$ and $R_3$ or on the nitrogen atoms in the acidic nucleus of D or D'.

The color sensitizing dyes to be used in the present invention, additionally include cyanine dyes, merocyanine dyes and complex merocyanine dyes. Further, complex cyanine dyes, holopolar cyanine dyes, hemicyanine dyes, styryl dyes and hemioxonol dyes may also be used. Suitable cyanine dyes include simple cyanine dyes, carbocyanine dyes, dicarbocyanine dyes and tricarbocyanine dyes.

Specific examples of the methine compounds of formula (I) for use in the present invention are shown below, but the invention is not limited thereto:

(1)
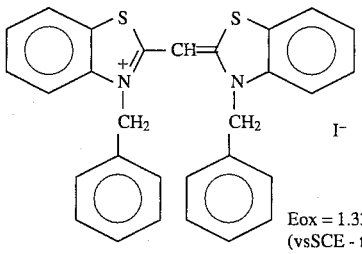
Eox = 1.33 V
(vsSCE - the same
shall apply hereunder
(2)
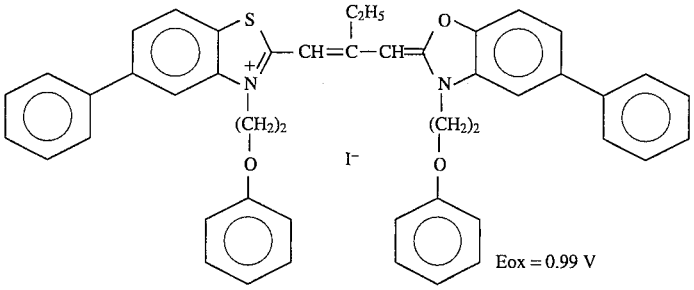
Eox = 0.99 V
(3)
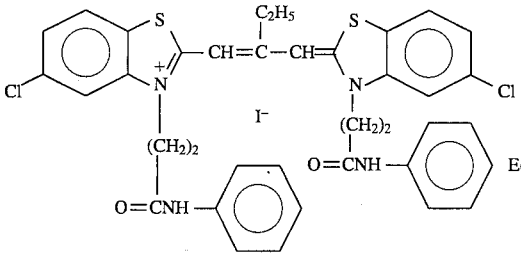
Eox = 0.936
(4)
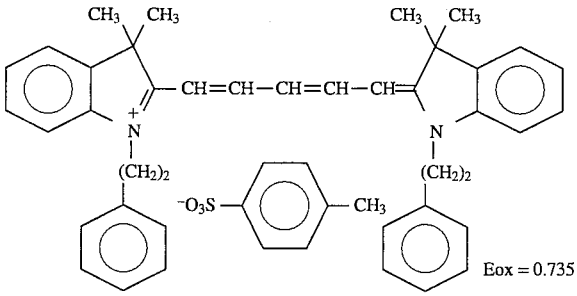
Eox = 0.735
(5)
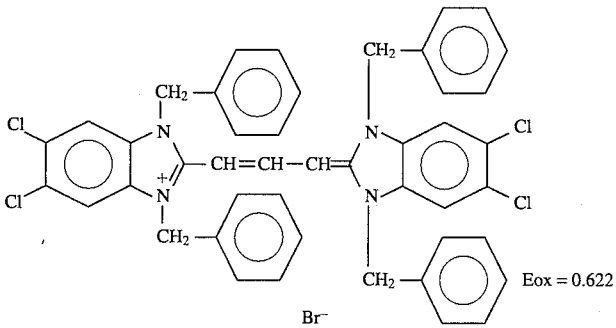
Eox = 0.622

-continued
(6)
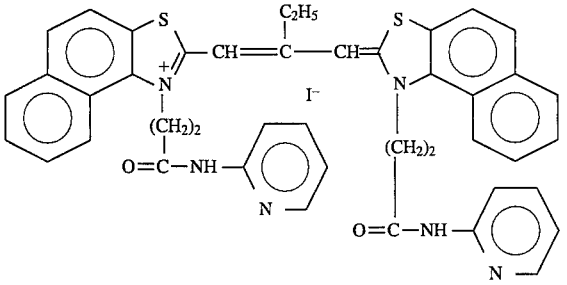
Eox = 0.823
(7)
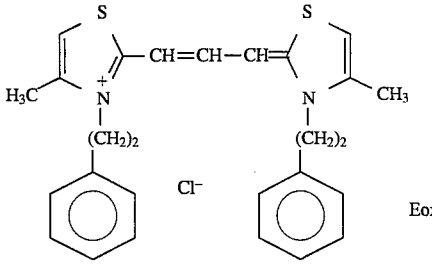
Eox = 0.596
(8)
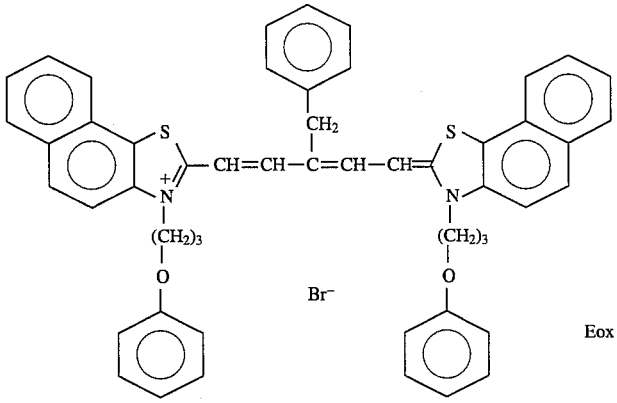
Eox = 0.44
(9)
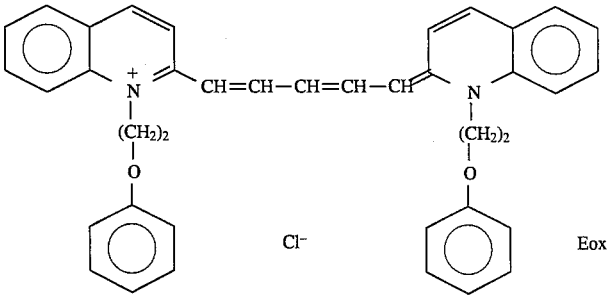
Eox = 0.475
(10)
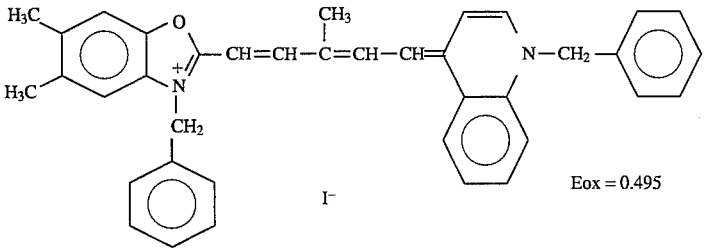
Eox = 0.495

-continued
(11)
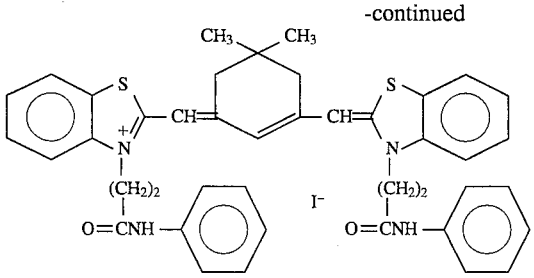
Eox = 0.51
(12)
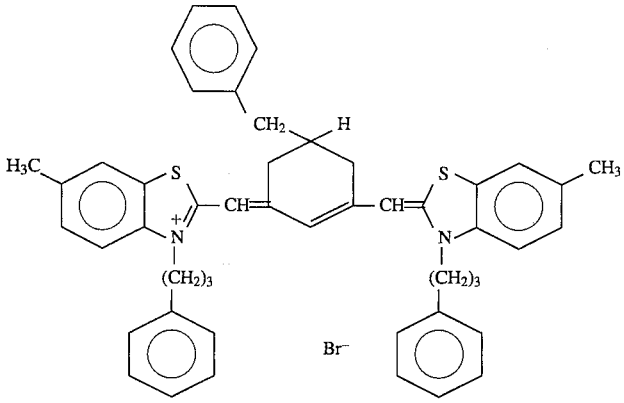
Eox = 0.48
(13)
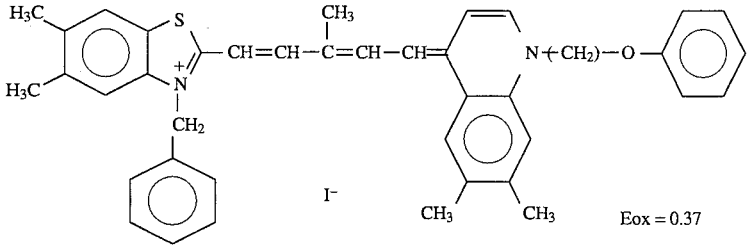
Eox = 0.37
(14)
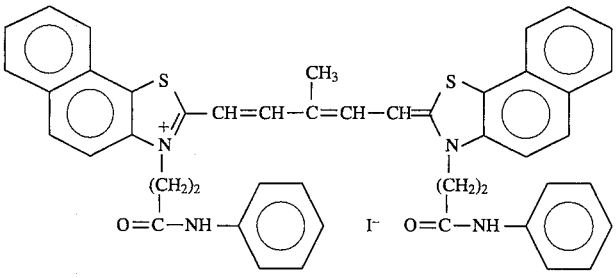
Eox = 0.44
(15)
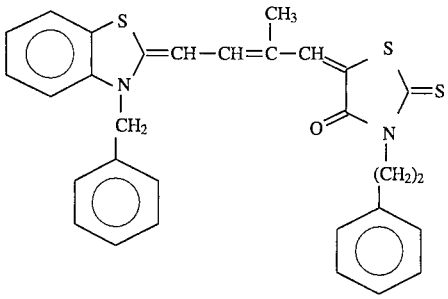
Eox = 0.45

-continued
(16)
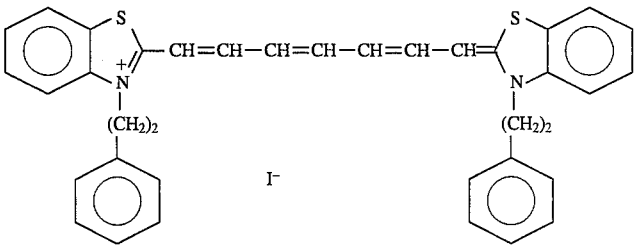
Eox = 0.385
(17)
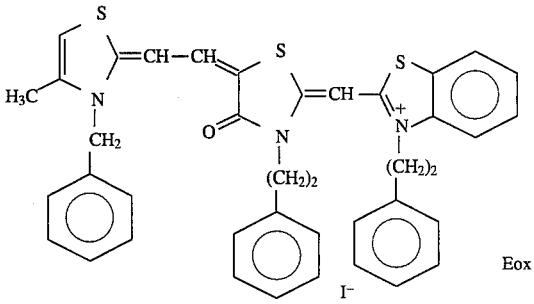
Eox = 0.49
(18)
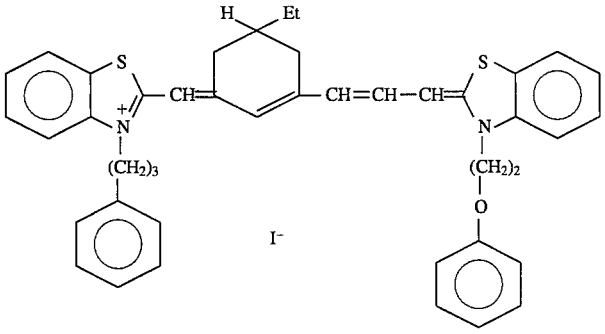
Eox = 0.374
(19)
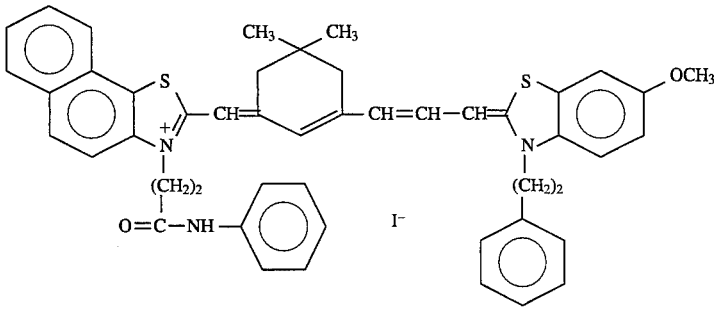
Eox = 0.29
(20)
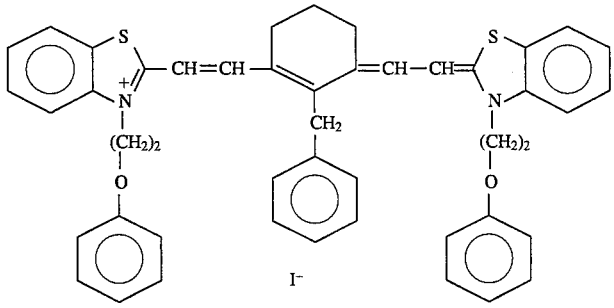
Eox = 0.294

-continued
(21)
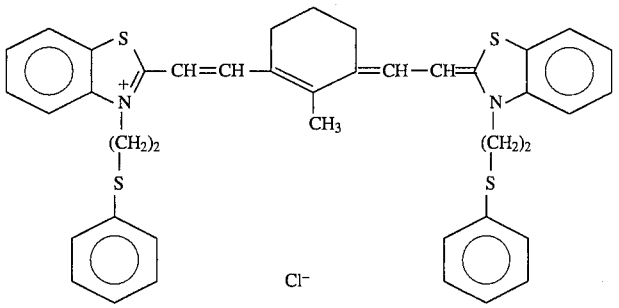
Eox = 0.254
(22)
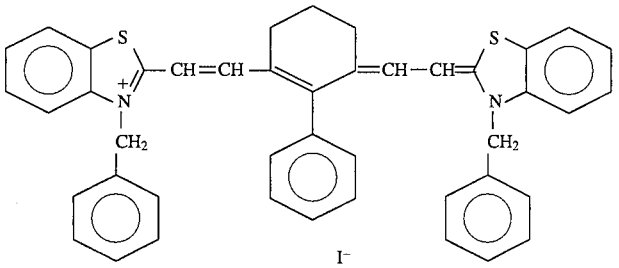
Eox = 0.298
(23)
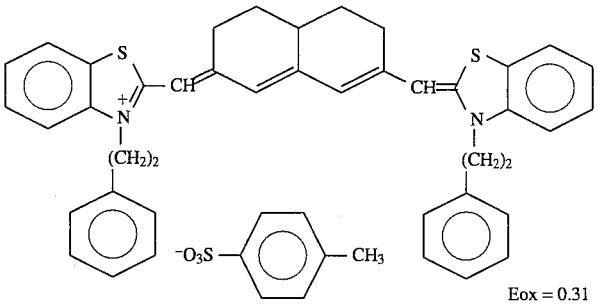
Eox = 0.31
(24)
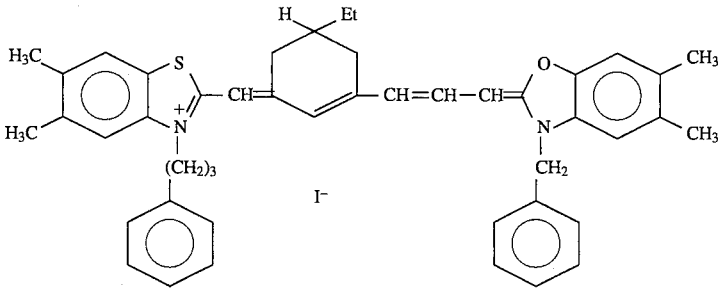
Eox = 0.31
(25)
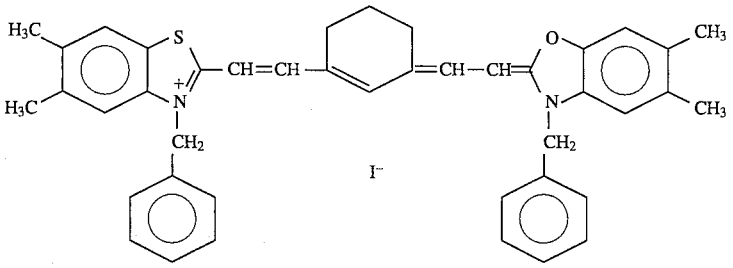
Eox = 0.29

-continued
(26)
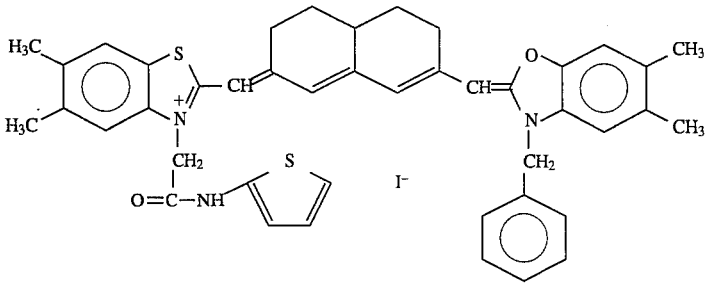
Eox = 0.30
(27)
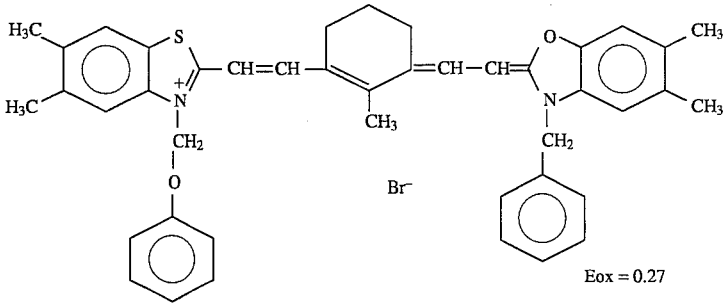
Eox = 0.27
(28)
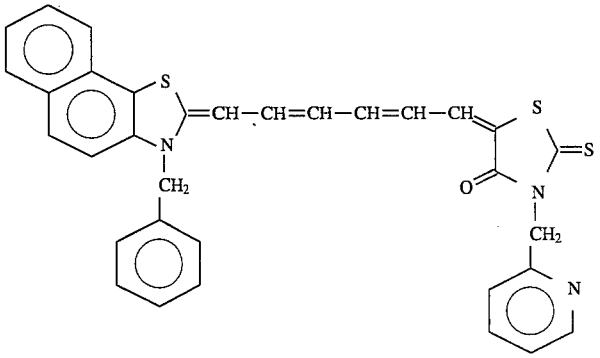
Eox = 0.35
(29)
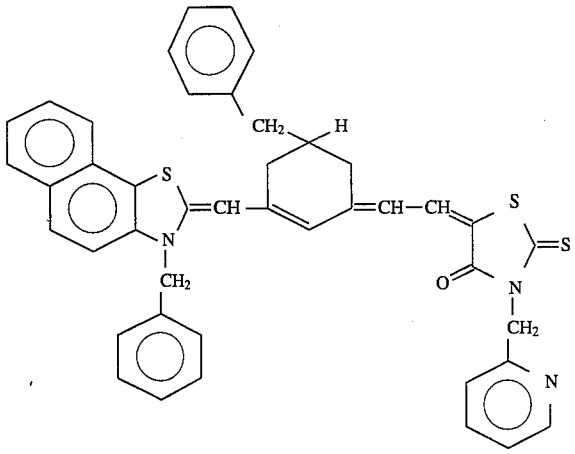
Eox = 0.31

-continued
(30)
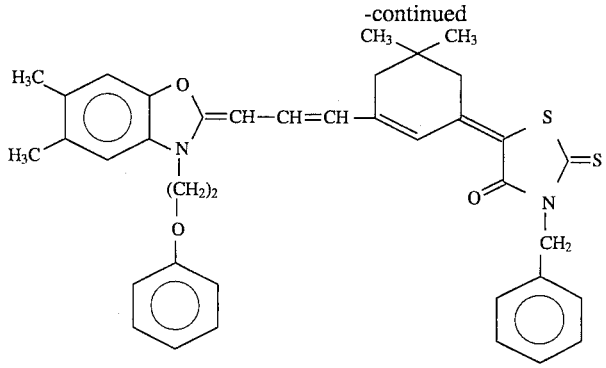
Eox = 0.41
(31)
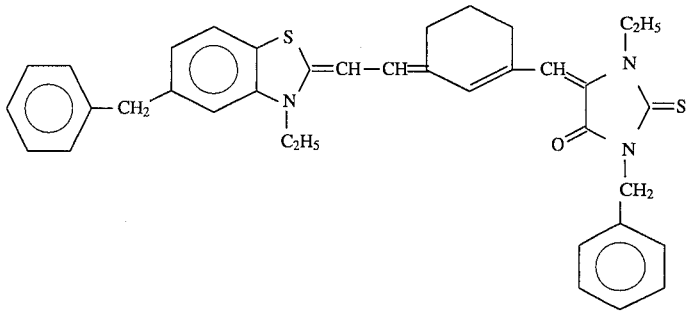
Eox = 0.35
(32)
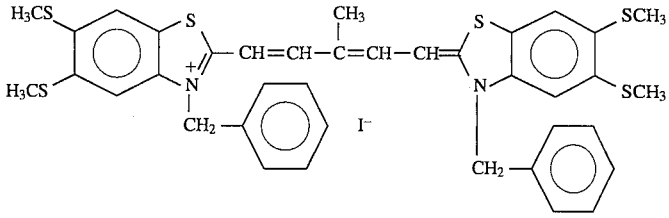
Eox = 0.52
(33)
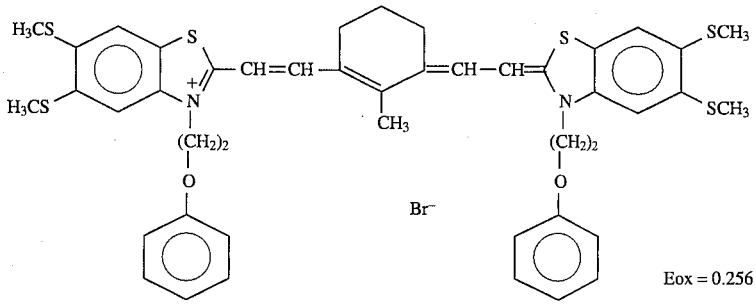
Eox = 0.256
(34)
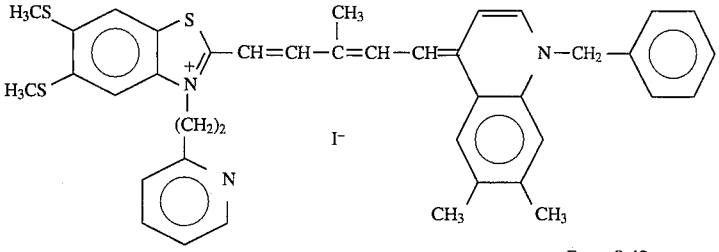
Eox = 0.42
The polymethine dyes of formula (I) for use in the present invention can be produced by known methods, for example, by the methods described in the following references:
a) F. M. Harmer, *Heterocyclic Compounds—Cyanine Dyes and Related Compounds* (published by John Wiley & Sons Co., New York, London), 1964.

b) D. M. Sturmer, *Heterocyclic Compounds—Special Topics in Heterocyclic Chemistry,* Chap. 8, Sec. 4, pages 482 to 515 (published by John Wiley & Sons Co., New York, London), 1977.

c) *Zh. Org. Khim.,* Vol. 17, No. 1, pages 167 to 169 (1981); Vol. 15, No. 2, pages 400 to 407 (1979); Vol. 14, No. 10, pages 2214 to 2221 (1978); Vol. 13, No. 11, pages 2440 to 2443 (1977); Vol. 19, No. 10, pages 2134 to 2142 (1983)

d) *Ukr. Khim. Zh.,* Vol 40, No. 6, pages 625 to 629 (1974).

e) *Khim. Geterotsikl. Soedin.,* No. 2, pages 175 to 178 (1976).

f) Russian Patents 420643 and 341823, JP-A-59- 217761 (the term "JP-A" as used herein means an "unexamined published Japanese patent application"), U.S. Pat. Nos. 4,334,000, 3,671,648, 3,623,881 and 3,573,921, European Patents 288261A1, 102781A2 and 102781A2, JP-B-49-46930 (the term "JP-B" as used herein means an "examined Japanese patent publication"), and U.S. Pat. Nos. 3,582, 344 and 2,734,900.

g) T. I. Tolmachev et al., *Dokl. Akad. Nauk SSSR,* No. 177, pages 869 to 872 (1967).

For the bond forming reactions of the ether bond forming reaction, the amido bond forming reactions and the ester bond forming reactions for the moiety —(Q)—Ar, any and every method known in the field of organic chemistry may be used. Briefly, suitable reactions include, for example, (1) a method of bonding the monocyclic moieties in MET and Ar, (2) a method of bonding the monocyclic moiety in Ar to the raw material and intermediate of producing a polymethine dye followed by effecting the subsequent dye forming reaction, and (3) a method of bonding the raw material and intermediate for forming the monocyclic moiety in Ar to the polymethine dye moiety followed by completing the monocyclic moiety in Ar. Any suitable method may be selected from them for the bond forming reactions. For the reactions, various references for organic synthesizing reactions may be referred to, including *New Experimental Chemistry Lectures,* No. 14, Production and Reaction of Organic Compounds, Vols. I to V (edited by Japan Chemical Society, published by Maruzen Publishing Co., Tokyo, 1977); Y. Ogata, *Theory of Organic Reaction* (published by Maruzen Publishing Co., Tokyo, 1962); and L. F. Fieser and M. Fieser, *Advanced Organic Chemistry* (published by Maruzen Publishing Co., Tokyo, 1962).

The silver halide emulsion of the present invention may have any halogen composition of silver bromide, silver iodobromide, silver iodochlorobromide, silver chlorobromide or silver chloride.

As the tabular grains for use in the present invention, preferred are those having a thickness of 0.5 μm or less, preferably 0.3 μm or less, and a diameter of preferably 0.6 μm or more, and a mean aspect ratio of 5 or more. Preferably, the emulsion of the present invention contains tabular grains in a proportion of 50% or more of the total projected area of all the grains therein.

The silver halide grains in the emulsion of the present invention may have different phases in the inside part (core) and the surface layer (shell) of each grain. Alternatively, they may also have a uniform phase throughout the grain. The grains may be either those forming a latent image essentially on the surfaces thereof (for example, a negative emulsion) or those of forming a latent image essentially in the inside parts thereof (for example, an internal latent image emulsion).

Preferred embodiments of the silver halide emulsion of the present invention will be mentioned below in detail.

In the present invention, a silver chlorobromide or silver chloride which does not substantially contain silver iodide is preferably used. The wording ". . . does not substantially contain silver iodide" as referred to herein means that the silver iodide content in the silver halide is 1 mol % or less, preferably 0.2 mol % or less. Regarding the halogen composition of the grains constituting an emulsion for use in the present invention, the. grains may have different halogen compositions. Preferably, however, the emulsion contains grains each having the same halogen composition, as the property of the grains may easily be homogenized. Regarding the halogen composition distribution of the grains constituting a silver halide emulsion for use in the present invention, the grain may have a so-called uniform halogen composition structure where any part of the grain has the same halogen composition; or the grain may have a so-called laminate (core/shell) structure where the halogen composition of the core of the grain is different from that of the shell of the same; or the grain may have a composite halogen composition structure where the inside or surface of the grain has a non-layered, different halogen composition part (for example, when such a non-layered, different halogen composition part is on the surface of the grain, it may be on the edge, corner or plane of the grain as a conjugated structure). Any of such structure grains may properly be selected.

In order to obtain a high sensitivity photographic material, the latter laminate or composite halogen composition structure grains are advantageously employed, rather than the first uniform halogen composition structure grains. Such laminate or composite halogen composition structure grains are also preferred in view of pressure resistance. In the case of laminate or composite halogen composition structure grains, the boundary between the different halogen composition parts may be a definite one or may be an indefinite one forming a mixed crystal structure because of the difference in the halogen compositions between the adjacent parts. If desired, the boundary between them may positively have a continuous structure variation.

For a photographic material for rapid processing, a so-called high silver chloride emulsion having a high silver chloride content is preferred. The silver chloride content in such a high silver chloride emulsion for use in the present invention is preferably 90 mol % or more, more preferably 95 mol % or more.

In such a high silver chloride emulsion, it is preferred that a silver bromide localized phase is in the inside and/or surface of the silver halide grain in the form of a layered or non-layered structure. The halogen composition in the localized phase is preferably such that the silver bromide content therein is at least 10 mol % or more, more preferably more than 20 mol %. The localized phase may be in the inside of the grain or on the edges or corners of the surface of the grain. In one preferred embodiment, the localized phase may be on the corner parts of the grain as an epitaxially grown phase.

For the purpose of minimizing the depression of the sensitivity of the photographic material when pressure is imparted to the material, it is also preferred that the high silver chloride emulsion having a silver chloride content of 90 mol % or more in the material contains uniform structure grains having a small halogen composition distribution in each grain.

For the purpose of reducing the amount of the replenisher to the developer for processing the photographic material, it is also effective to elevate further the silver chloride content in the silver halide emulsion constituting the material. In such a case, an emulsion of an almost pure silver chloride having a silver chloride content of from 98 mol % to 100 mol % is preferably used.

The silver halide grains constituting the silver halide emulsion of the present invention may have a mean grain size of preferably from 0.1 μm to 2 μm. (The grain size indicates the diameter of a circle having an area equivalent to the projected area of the grain, and the mean grain size indicates a number average value obtained from the measured grain sizes.)

Regarding the grain size distribution of the emulsion, a so-called monodispersed emulsion having a fluctuation coefficient (obtained by dividing the standard deviation of the grain size distribution by the mean grain size) of 20% or less, preferably 15% or less is preferred. For the purpose of obtaining a broad latitude, two or more monodispersed emulsions may be blended to form a mixed emulsion for one layer, or they may be separately coated to form a plurality of layers. Such blending or separate coating is preferably effected for the purpose.

Regarding the shape of the silver halide grains constituting the silver halide emulsion of the present invention, the grains may be regular crystalline ones such as cubic, tetradecahedral or octahedral crystalline ones, or irregular crystalline ones such as spherical or tabular crystalline ones, or may be composite crystalline ones composed of such regular and irregular crystalline ones. The emulsion may also be composed of grains of different crystalline forms. Above all, the emulsion of the present invention preferably contains regular crystalline grains in a proportion of 50% or more, preferably 70% or more, more preferably 90% or more.

In addition, the emulsion of the present invention may also contain tabular grains having a mean aspect ratio (circle-corresponding diameter/thickness) of 5 or more, preferably 8 or more, preferably in a proportion of more than 50% of the total projected area of all the grains therein.

The silver chlorobromide emulsion for use in the present invention can be produced by various known methods, for example, by the methods described in P. Glafkides, *Chemie et Phisigue Photographigue* (published by Paul Montel, 1967); G. F. Duffin, *Photographic Emulsion Chemistry* (published by Focal Press, 1966); and V. L. Zelikman et al., *Making and Coating Photographic Emulsion* (published by Focal Press, 1964). Briefly, any of the known acid, neutral and ammonia methods may be employed. As a system of reacting a soluble silver salt and soluble halide(s), any of the known single jet and double jet methods or a combination thereof may be employed. A so-called reverse mixing method for forming grains in an atmosphere having excess silver ions may also be employed. In one system of a double jet method, a so-called controlled double jet method of keeping the pAg value constant in the liquid phase for forming silver halide grains may also be employed. In accordance with the method, an emulsion of silver halide grains each having a regular crystalline form and an almost uniform grain size may be obtained.

The silver halide emulsion of the present invention can contain various polyvalent metal ion impurities, which may be introduced thereinto during their formation or during their physical ripening. Examples of suitable compounds for the purpose include salts of cadmium, zinc, lead, copper or thallium, as well as salts and complexes of elements of Group VIII, such as iron, ruthenium, rhodium, palladium, osmium, iridium or platinum. In particular, the elements of Group VIII are preferred. The amount of the compounds to be added may vary broadly in accordance with the object and is preferably from $10^{-9}$ to $10^{-2}$ mol to silver halide.

The silver halide emulsion of the present invention is, in general, chemically sensitized or spectrally sensitized.

For chemical sensitization, sulfur sensitization effected by adding an unstable sulfur compound, noble metal sensitization such as gold sensitization, and reduction sensitization, or a combination of them are suitable. As compounds to be used for such chemical sensitization, preferred are those described in JP-A-62-215272, from page 18, left bottom column to page 22, right top column.

Spectral sensitization or color sensitization is effected for the purpose of making the respective emulsion layers constituting the photographic material of the present invention sensitive to the desired light wavelength range. In the present invention, preferred is the addition of a dye (or a color sensitizing dye) capable of absorbing a light of a wavelength range corresponding to the intended color sensitivity to each emulsion. Examples of color sensitizing dyes suitable for the purpose are described in, for example, F. M. Harmer, *Heterocyclic Compounds—Cyanine Dyes and Related Compounds* (published by John Wiley & Sons Co., New York, London), 1964. In addition, specific examples of preferable compounds as well as color sensitization methods using them are described in JP-A-62-215272, from page 22, right top column to page 38.

The silver halide emulsion of the present invention may contain various compounds as well as precursors thereof, for the purpose of preventing fog of the photographic materials or of stabilizing their photographic properties, during their manufacture, storage or processing. Specific examples of compounds preferable for these purposes are described in JP-A-62-215272, from page 39 to page 72.

The emulsion of the present invention is a so-called surface latent image type emulsion for forming a latent image essentially on the surfaces of the grains therein.

Where a semiconductor laser is used as a light source for digital exposure of the photographic material of the present invention, infrared sensitization of the material must be effected efficiently.

In particular, for color sensitization of the material in the range of 700 nm or more, use of methine compounds of formulae (II) and (III) is preferred.

Since infrared sensitization is effected by M-band sensitizing dyes, the color sensitivity distribution by infrared sensitization is generally broader than that effected by J-band sensitization. Therefore, it is preferred to correct or compensate the color sensitivity distribution by providing a dye-containing color colloid layer over the determined light-sensitive layer. The color layer is effective for preventing color mixing due to the filter effect.

Where a color sensitizing dye is incorporated into a silver halide emulsion, it may be directly added to the emulsion, or alternatively, it may be first dissolved in a single solvent or mixed solvent of water, methanol, ethanol, propanol, methyl cellosolve and/or 2,2,3,3-tetrafluoropropanol, and thereafter the resulting solution may be added to the emulsion. In addition, it is also possible to form an aqueous solution of the dye in the presence of an acid or base, as described in JP-B-44- 23389, JP-B-44-27555 and JP-B-57-22089, or to form an aqueous solution or colloidal dispersion in the presence of a surfactant as described in U.S. Pat. Nos. 3,822,135 and 4,006,025; and the resulting solution or dispersion may be added to the emulsion. Further, it is also possible to dissolve the dye in phenoxyethanol or a solvent which is substantially immiscible in water, and then to disperse the resulting solution in water or a hydrophilic colloid; and the resulting dispersion may be added to the emulsion. Further, the dye may also be dispersed directly into a hydrophilic colloid, as described in JP-A-53-102733 and JP-A-58-105141, and the resulting dispersion may be added to the emulsion.

The time of adding the dye to the emulsion may be any time which has heretofore been known to be suitable in preparing photographic emulsions. Precisely, the time may be selected from (1) before the formation of the silver halide grains, (2) during the formation thereof, (3) immediately after the formation thereof to before the washing of them, (4) before the chemical sensitization thereof, (5) during the chemical sensitization thereof, (6) immediately after the chemical sensitization thereof to before the cooling and solidification thereof, and (7) during the preparation of the coating composition containing them. Most often, addition of the dye is effected at any time after completion of the chemical sensitization of the emulsion and before coating it.

If desired, the dye may be added to the emulsion at the same time of adding a chemical sensitizing agent thereto so as to effect color sensitization and chemical sensitization simultaneously, as described in U.S. Pat. Nos. 3,628,969 and 4,225,666; or color sensitization may be effected prior to chemical sensitization as described in JP-A-58-113928; or the dye may be added before completion of formation of precipitates of silver halide grains to start the color sensitization prior to formation of the grains. In addition, it is possible to stepwise partially add the color sensitizing dye as described in U.S. Pat. No. 4,225,666; that is, a part of the dye is added prior to chemical sensitization of the emulsion and the remaining part thereof is added after the chemical sensitization of the same. In any event, addition of a color sensitizing dye to an emulsion may be effected at any stage of forming silver halide grains of the emulsion by any known method, for example, as taught in U.S. Pat. No. 4,183,756. Especially preferably, the dye is added to an emulsion before washing it with water or before its chemical sensitization.

The amount of the color sensitizing dye to be added to the emulsion may vary broadly, and preferably it is from $0.5\times10^{-6}$ mol to $1.0\times10^{-2}$ mol, more preferably from $1.0\times10^{-6}$ mol to $5.0\times10^{-3}$ mol, per mol of silver halide.

For red to infrared sensitization of the emulsion of the present invention by M-band type sensitization, the supersensitization with the compounds described in JP-A-2-157749, from page 13, left bottom column, line 3 to page 22, right bottom column, line 3 from below is especially effective.

The constitution of the photographic material of the present invention is explained hereunder. The photographic material prepared with the present invention has at least three silver halide emulsion layers on a support, at least two layers of which are desired to have a color sensitivity peak at 670 nm or more. Preferably, the light-sensitive layers each contain at least one coupler capable of coloring by a coupling reaction with an oxidation product of an aromatic amine compound. As a photographic material for full color hard copies, it is preferred that the material has at least three silver halide light-sensitive layers each having a different color sensitivity on a support and that each layer contains yellow, magenta or cyan couplers capable of coloring by a coupling reaction with an oxidation product of an aromatic amine compound. The three kinds of color sensitivities may freely be selected in accordance with the wavelength range of the light source to be used for digital exposure. From the viewpoint of color separation, it is desired that the nearest adjacent color sensitivity peaks are separated from each other by at least 30 nm. The relationship between the couplers (Y, M, C) and the at least three light-sensitive layers ($\lambda1$, $\lambda2$, $\lambda3$) each having a different color sensitivity peak is not specifically defined. That is to say, six ways (3×2=6) are possible for each combination of coupler and layer.

The order of coating the at least three light-sensitive layers each having a different color sensitivity peak on the support is not also specifically defined. From the viewpoint of rapid processability, it is often preferred that a light-sensitive layer containing silver halide grains having the largest mean grain size and having the longest wave color sensitivity is the uppermost layer. Therefore, the number of possible of combinations of the three kinds of different color sensitivities, the three kinds of color couplers and the position of the layers on the support is 36. The present invention may be effectively applicable to any photographic material of these 36 possibilities.

In the present invention, a semiconductor laser is preferably used as the light source for digital exposure. In that case, it is preferred that at least one light-sensitive layer of the at least three silver halide emulsion layers each having a different color sensitivity has a color sensitivity peak at 730 nm or more and that at least two layers thereof each have a color sensitivity peak in a long wavelength range of 670 nm or more. Also in that case, there is no particular limitation on the color sensitivity peaks, the kinds of color couplers and the positions of the layers. Table 1 below shows specific examples of light sources for digital exposure of photographic materials along with the color sensitivity peaks of the materials corresponding thereto and color couplers in the materials, but the present invention is not limited thereto.

TABLE 1

| Light Source for Digital Exposure | | | Color Sensitivity Peak of |
|---|---|---|---|
| Light Source | Wavelength (nm) | Color Coupler | Photographic Material (nm) |
| 1 | | | |
| AlGaInAs (670) | 670 | C | 670 |
| GaAlAs (750) | 750 | Y | 730 |
| GaAlAs (810) | 810 | M | 810 |
| 2 | | | |
| AlGaInAs (670) | 670 | Y | 670 |
| GaAlAs (750) | 750 | M | 730 |
| GaAlAs (810) | 810 | C | 810 |
| 3 | | | |
| AlGaInAs (670) | 670 | M | 670 |
| GaAlAs (750) | 750 | C | 750 |
| GaAlAs (830) | 830 | Y | 830 |
| 4 | | | |
| AlGaInAs (670) | 670 | Y | 670 |
| GaAlAs (780) | 780 | M | 780 |
| GaAlAs (830) | 880 | C | 840 |
| 5 | | | |
| AlGaInAs (670) | 670 | C | 670 |
| GaAlAs (780) | 780 | M | 780 |
| GaAlAs (880) | 880 | Y | 880 |
| 6 | | | |
| GaAlAs (780) | 780 | M | 780 |
| GaAlAs (830) | 830 | Y | 830 |
| GaAlAs (880) | 880 | C | 880 |
| 7 | | | |
| GaAs (1200) + SHG 1) | 600 | M | 600 |
| AlGaInAs (670) | 670 | Y | 670 |
| GaAlAs (880) | 750 | C | 750 |

TABLE 1-continued

| Light Source for Digital Exposure | | | Color Sensitivity Peak of |
|---|---|---|---|
| Light Source | Wavelength (nm) | Color Coupler | Photographic Material (nm) |
| 8 | | | |
| LED (580) | 580 | Y | 580 |
| LED (670) | 670 | M | 670 |
| LED (810) | 810 | C | 810 |

1) SHG: Secondary Higher Harmonics with non-linear optical element were used.

Exposure of photographic materials of the present invention is described below. It is preferred that the photographic material of the present invention is imagewise exposed by a scanning digital exposure system in which a high-density beam light such as laser or LED is applied to the material with the beam light moving relatively to the material. Therefore, the time during which the silver halide in the photographic material is exposed to the light is a time necessary for exposing a certain small area of the material. As the small area of the material, the minimum unit controlling the light amount from the respective digital data is generally used, which is called a pixel (picture element). Therefore, in accordance with the size of the pixel, the exposure time per pixel varies. The size of the pixel depends upon the pixel density, which is, as an actual range, from 50 to 2000 dpi. The exposure time is, when it is defined to be the time of exposing the pixel size of 400 dpi as the pixel density, preferably $10^{-4}$ second or less, more preferably $10^{-6}$ second or less.

Preferably, dyes which may be decolored by photographic processing, such as those described in EP-A- 0337490 (pages 27 to 76), especially oxonole dyes, are added to the hydrophilic colloid layer of the photographic material of the present invention for the purpose of elevating the sharpness of the images formed, in such a way that the optical reflection density of the material at 680 nm may be 0.70 or more; or titanium oxide grains, the surfaces of which have been treated with di- to tetrahydric alcohols (for example, trimethylol ethane), are added to the water-proofing resin layer of the support in an amount of 12% by weight or more, more preferably 14% by weight or more.

The photographic material of the present invention may contain colloidal silver and dyes for the purpose of anti-irradiation and anti-halation, especially for the purpose of separation of the color sensitivity distribution of the respective light-sensitive layers and for the purpose of ensuring safety to safelight.

Examples of dyes suitable for these purposes include oxonole dyes having a pyrazolone nucleus, a barbituric nucleus or a barbituric acid nucleus, such as those described in U.S. Pat. Nos. 506,385, 1,177,429, 1,131,884, 1,338,799, 1,385,371, 1,467,214, 1,433,102 and 1,553,516, JP-A-48-85130, JP-A-49-114420, JP-A-52-117123, JP-A-55-161233, JP-A-59-111640, JP-B-39-22069, JP-B-43- 13168, JP-B-62-273527, and U.S. Pat. Nos. 3,247,127, 3,469,985 and 4,078,933; other oxonole dyes described in U.S. Pat. Nos. 2,533,472 and 3,379,533, British Patent 1,278,621, JP-A-1-134447, and JP-A-1-183652; azo dyes described in British Patents 575,691, 680,631, 599,623, 786,907, 907, 125 and 1,045,609, U.S. Pat. No. 4,255,326, and JP-A-59-211043; azomethine dyes described in JP-A-50- 100116, JP-A-54-118247, and British Patents 2,014,598 and 750, 031; anthraquinone dyes described in U.S. Pat. No. 2,865, 752; arylidene dyes described in U.S. Pat. Nos. 2,538,009, 2,688,541 and 2,538,008, British Patents 584,609 and 1,210, 252, JP-A-50-40625, JP-A-51-3623, JP-A- 51-10927, JP-A-54-118247, JP-B-48-3286, and JP-B-59-37303; styryl dyes described in JP-B-28-3082, JP-B-44-16594, and JP-B-59-28898; triarylmethane dyes described in British Patents 446,538 and 1,335,422, and JP-A-59-228250; merocyanine dyes described in British Patents 1,075,653, 1,153,341, 1,284,730, 1,475,228 and 1,542,807; and cyanine dyes described in U.S. Pat. Nos. 2,843,486 and 3,294,539 and JP-A-1-291247.

For the purpose of preventing diffusion of these dyes in the photographic material, the following methods may be employed. In one method, for example, a ballast group is introduced to the dyes so that the dyes are made non-diffusive.

In another method, for example, a hydrophilic polymer charged oppositely to the dissociated anionic dye is incorporated into the dye-containing layer as a mordant agent, whereby the dye is localized in the particular layer because of interaction between the hydrophilic polymer and the dye molecule, as described in U.S. Pat. Nos. 2,548,564, 4,124, 386 and 3,625,694.

In still another method, a water-insoluble solid dye is used for coloring a particular dye, for example, as described in JP-A-56-12639, JP-A-55-155350, JP-A-55- 155351, JP-A-63-27838, JP-A-63-197943, and European Patent 15,601.

In still another method, a particular layer is colored with fine grains of a metal salt to which dye grains have been adsorbed, as described in U.S. Pat. Nos. 2,719,088, 2,496, 841 and 2,496,843, JP-A-60-45237.

The photographic material of the present invention preferably contains a color image storability improving compound, such as those described in EP-A-0277589, along with couplers, especially pyrazoloazole couplers.

Specifically, incorporation of a compound (F) which may be chemically bonded to the aromatic amine developing agent remaining after color development to form a chemically inert and substantially colorless compound and/or a compound (G) which may be chemically bonded to an oxidation product of the aromatic amine developing agent remaining after color development to form a chemically inert and substantially colorless compound, into the photographic material of the present invention is preferred, for example, for the purpose of preventing formation of stains and preventing any other unfavorable side effect caused by color dye formed through reaction of the remaining color developing agent or an oxidation product thereof and couplers in the photographic material during storage of the processed material.

In addition, the photographic material of the present invention also preferably contains various microbicides such as those described in JP-A-63-271247, for the purpose of exterminating various fungi and bacteria which would propagate in the hydrophilic colloid layers and deteriorate the images formed.

As the support in the photographic material of the present invention, a white polyester support or a support coated with a white pigment-containing layer on the surface having silver halide emulsion layers thereon may be used for display of the images formed on the material. In addition, for the purpose of improving the sharpness of the images formed, an anti-halation layer is desired to be formed on either surface of the support. In particular, it is preferred that the transmittance density of the support is defined to fall within the range of from 0.35 to 0.8 in order that the displayed images may be seen by either a reflected light or a transmitted light.

The exposed photographic material is processed by conventional black-and-white development or color development. Where the material of the present invention is a color photographic material, it should be first subjected to color development and then to bleach-fixation for the purpose of effecting rapid processing. In particular, where the material contains the above-mentioned high silver chloride emulsion, the pH value of the bleach-fixing solution used for processing is desired to be about 6.5 or less, especially preferably about 6 or less, for promoting the desilvering speed.

For silver halide emulsions and other elements (additives, etc.) constituting the photographic materials of the present invention as well as the constitution of photographic layers (arrangement of layers, etc.) of the materials, and the processing methods and processing additives to be used for processing the materials, for example, disclosures of the following references, especially the following EP-A-0355660 (corresponding to Japanese Patent Application No. 1-107011), may be referred to.

| Photographic Elements | JP-A-62-215272 | JP-A-2-33144 | EP-A-0355660 |
|---|---|---|---|
| Silver Halide Emulsions | From page 10, right upper column, line 6 to page 12, left lower column, line 5; and from page 12, right lower column, line 4 from below to page 13, left upper column, line 17 | From page 28, right upper column, line 16 to page 29, right lower column, line 11; and page 30, lines 2 to 5 | From page 45, line 53 to page 47, line 3; and page 47, lines 20 to 22 |
| Silver Halide Solvents | Page 12, left lower column, lines 6 to 14; and from page 13, left upper column, line 3 from below to page 18, left lower column, last line | — | — |
| Chemical Sensitizers | Page 12, from left lower column, line 3 from below to right lower column, line 5 from below; and from page 18, right lower column, line 1 to page 22, right upper column, line 9 from below | Page 29, right lower column, line 12 to last line | Page 47, lines 4 to 9 |
| Color Sensitizers (Color Sensitizing Methods) | From page 22, right upper column, line 8 from below to page 38, last line | Page 30, left upper column, lines 1 to 13 | Page 47, lines 10 to 15 |
| Emulsion Stabilizers | From page 39, left upper column, line 1 to page 72, right upper column, last line | Page 30, from left upper column, line 14 to right upper column, line 1 | Page 47, lines 16 to 19 |
| Development Promoters | From page 72, left lower column, line 1 to page 91, right upper column, line 3 | — | — |
| Color Couplers (Cyan, Magenta and Yellow Couplers) | From page 91, right upper column, line 4 to page 121, left upper column, line 6 | From page 3, right upper column, line 14 to page 18, left upper column, last line; and from page 30, right upper column, line 6 to page 35, right lower column, line 11 | Page 4, lines 15 to 27; from page 5, line 30 to page 28, last line; page 45, lines 29 to 31; and from page 47, line 23 to page 63, line 50 |
| Coloring Enhancers | From page 121, left upper column, line 7 to page 125, right upper column, line 1 | — | — |
| Ultraviolet Absorbents | From page 125, right upper column, line 2 to page 127, left lower column, last line | From page 37, right lower column, line 14 to page 38, left upper column, line 11 | Page 65, lines 22 to 31 |
| Anti-fading Agents (Color Image Stabilizers) | From page 127, right lower column, line 1 to page 137, left lower column, line 8 | From page 36, right upper column, line 12 to page 37, left upper column, line 19 | From page 4, line 30 to page 5, line 23; from page 29, line 1 to page 45, line 25; page 45, lines 33 to 40; and page 65, lines 2 to 21 |
| High Boiling Point and/or Low Boiling | From page 137, left lower column, line 9 | From page 35, right lower column, line 14 | Page 64, lines 1 to 51 |

-continued

| Photographic Elements | JP-A-62-215272 | JP-A-2-33144 | EP-A-0355660 |
|---|---|---|---|
| Point Organic Solvents | to page 144, right upper column, last line | to page 36, left upper column, line 4 from below | |
| Dispersing Methods of Photographic Additives | From page 144, left lower column, line 1 to page 146, right upper column, line 7 | From page 27, right lower column, line 10 to page 28, left upper column, last line; and from page 35, right lower column, line 12, to page 36, right upper column, line 7 | From page 63, line 51 to page 64, line 56 |
| Hardening Agents | From page 146, right upper column, line 8 to page 155, left lower column, line 4 | — | — |
| Developing Agent Precursors | Page 155, from left lower column, line 5 to right lower column, line 2 | — | — |
| Development Inhibitor Releasing Compounds | Page 155, right lower column, lines 3 to 9 | — | — |
| Supports | From page 155, right lower column, line 19 to page 156, left upper column, line 14 | From page 38, right upper column, line 18 to page 39, left upper column, line 3 | From page 66, line 29 to page 67, line 13 |
| Constitution of Photographic Layers | Page 156, from left upper column, line 15 to right lower column line 14 | Page 28, right upper column, lines 1 to 15 | Page 45, lines 41 to 52 |
| Dyes | From page 156, right lower column, line 15 to page 184, right lower column, last line | Page 38, from left upper column, line 12 to right upper column, line 7 | Page 66, lines 18 to 22 |
| Color Mixing Preventing Agents | From page 185, left upper column, line 1 to page 188, right lower column, line 3 | Page 36, right upper column, lines 8 to 11 | From page 64, line 57 to page 65, line 1 |
| Gradation Adjusting Agents | Page 188, right lower column, lines 4 to 8 | — | — |
| Stain Inhibitors | From page 188, right lower column, line 9 to page 193, right lower column, line 10 | Page 37, from left upper column, last line to right lower column, line 13 | From page 65, line 32 to page 66, line 17 |
| Surfactants | From page 201, left lower column, line 1 to page 210, right upper column, last line | From page 18, right upper column, line 1 to page 24, right lower column, last line; and page 27, from left lower column, line 10 from below to right lower column, line 9 | — |
| Fluorine-containing Compounds (antistatic agents, coating aids, lubricants, and anti-blocking agents) | From page 210, left lower column, line 1 to page 222, left lower column, line 5 | From page 25, left upper column, line 1 to page 27, right lower column, line 9 | — |
| Binders (hydrophilic colloids) | From page 222, left lower column, line 6 to page 225, left upper column, last line | Page 38, right upper column, lines 8 to 18 | Page 66, lines 23 to 28 |
| Tackifiers | From page 225, right upper column, line 1 to page 227, right upper column, line 2 | — | — |
| Antistatic Agents | From page 227, right upper column, line 3 to page 230, left upper column, line 1 | — | — |
| Polymer Latexes | From page 230, left upper column, line 2 to page 239, last line | — | — |
| Mat Agents | Page 240, from left upper column, line 1 to right upper column, | — | — |

-continued

| Photographic Elements | JP-A-62-215272 | JP-A-2-33144 | EP-A-0355660 |
|---|---|---|---|
| | last line | | |
| Photographic Processing Methods (processing steps and additives) | From page 3, right upper column, line 7 to page 10, right upper column, line 5 | From page 39, left upper column, line 4 to page 42, left upper column, last line | From page 67, line 14 to page 69, line 28 |

Notes:
The cited specification of JP-A-62-215272 is one amended by the letter of amendment filed on March 16, 1987.

As yellow couplers, the so-called short-wave type yellow couplers described in JP-A-63-231451, JP-A-63- 23047, JP-A-63-241547, JP-A-1-173499, JP-A-1-213648 and JP-A-1-250944 are also preferably employed, in addition to those mentioned above.

As cyan couplers, the 3-hydroxypyridine cyan couplers described in EP-A-0333185 (especially, 2-equivalentized couplers formed by adding a chlorinated splitoff group to the illustrated 4-equivalent Coupler (42), as well as the illustrated Couplers (6) and (9)), and cyclic active methylene cyan couplers described in JP-A-64-32260 (especially, Couplers Nos. 3, 8 and 34 concretely illustrated therein) are also preferably employed, in addition to diphenylimidazole cyan couplers described in the abovementioned JP-A-2-33144.

The processing temperature in processing the photographic material of the present invention with a color developer is from 20° to 50° C., preferably from 30° to 45° C. The processing time is preferably substantially within 20 seconds. The amount of the replenisher to the color developer is desired to be as small as possible. Suitably, it may be from 20 to 600 ml, preferably from 50 to 300 ml, more preferably from 60 to 200 ml, most preferably from 60 to 150 ml, per m2 of the photographic material being processed.

In processing the photographic material of the present invention, the developing time is desired to be substantially within 20 seconds. The time of "substantially within 20 seconds" as referred to herein indicates the time from introduction of the photographic material to be developed into the developer tank to transfer of the material to the next tank, including the blank transition time from the developer tank to the next tank.

The washing step or stabilization step for processing the developed photographic material of the present invention is desired to have a pH condition of from 4 to 10, more preferably from 5 to 8. The temperature for the step may be determined variously in accordance with the use and characteristics of the photographic material being processed. In general, it may be from 30° to 45° C., preferably from 35° to 42° C. The processing time for the step may also be determined freely, but it is desired to be as short as possible from the viewpoint of shortening the processing time. Preferably, it may be from 10 to 45 seconds, more preferably from 10 to 40 seconds. The amount of the replenisher to the step is desired to be as small as possible from the viewpoint of reducing the running cost, reducing the amount of the waste to be drained and improving the easy handlability of the material being processed.

Concretely, the amount of the replenisher may be from 0.5 to 50 times, preferably from 2 to 15 times, of the carryover from the previous bath, per the unit area of the photographic material being processed; or it may be 300 ml or less, preferably 150 ml or less, per m2 of the photographic material being processed. Replenishment may be effected either continuously or intermittently.

The liquid used in the washing and/or stabilizing step may be used again in the previous step. One preferred example of the system is a multi-stage countercurrent system, in which the overflow of the washing water from the washing step may be recirculated into the previous bleach-fixing bath and a concentrated bleach-fixing liquid is replenished to the bleach-fixing bath so that the amount of the waste drained from the process may be reduced.

A drying step employable in processing the photographic material of the present invention will be described below.

In order to complete photographic images by ultrarapid processing of the present invention, the drying time is desired to be from 20 seconds-to 40 seconds. As a means of shortening the drying time, for example, the amount of the hydrophilic binder such as gelatin in the photographic material is reduced whereby the amount of the water to be introduced into the photographic material being processed may be reduced. In addition, for the purpose of reducing the amount of the water to be introduced into the photographic material being processed, the material is squeezed with squeezing rollers or rubbed with cloth immediately after being taken out of the washing bath so as to remove water from the material, whereby drying the washed material may be promoted. Naturally, the drier may also be improved so as to shorten the drying time, for example, by elevating the drying temperature or by enhancing the drying air. In addition, the angle of the drying air to be applied to the material being processed may suitably be adjusted or removal of the exhaust air from the drying chamber may be adjusted, whereby drying of the material being processed may be promoted further.

The present invention will be explained in more detail by way of the following examples, which, however, are not to be considered limiting.

EXAMPLE 1

Preparation of Emulsion A 3.3 g of sodium chloride was added to aqueous 3% lime-processed gelatin, and 3.2 ml of N,N'-dimethylimidazolidine- 2-thione (aqueous 1% solution) was added thereto. An aqueous solution containing 0.2 mol of silver nitrate and an aqueous solution containing 0.2 mol of sodium chloride and 15 μg of rhodium trichloride were added to and blended with the resulting solution at 56° C. with vigorously stirring. Subsequently, an aqueous solution containing 0.780 mol of silver nitrate and an aqueous solution containing 0.780 mol of sodium chloride and 4.2 mg of potassium ferricyanide were added and blended therewith at 56° C., also with vigorously stirring. Five minutes after completion of addition of the aqueous silver nitrate solution and the aqueous alkali halide solution, an aqueous solution containing 0.020 mol of silver nitrate and an aqueous solution containing 0.015 mol of potassium bromide, 0.005 mol of sodium chloride and 0.8 mg of potassium hexachloroiridate(IV) were added and blended therewith at 40° C. with vigorously stirring. Next, a copolymer of isobutene-monosodium maleate was added thereto for flocculation. After being washed with water, the resulting emulsion was de-salted. Further, 90.0 g of lime-processed gelatin was added thereto so that the pH and pAg values of the emulsion were adjusted to be 6.2 and 6.5, respectively. In addition, $1\times10^{-5}$ mol/mol-Ag of a sulfur sensitizing agent (triethylthiourea), $1\times10^{-5}$ mol/mol-Ag of chloroauric acid and 0.2 g/mol-Ag of nucleic acid were added to the emulsion for effecting optimum chemical sensitization at 50° C.

From the electromicroscopic photograph of the thus obtained silver chlorobromide emulsion (A), determined were the shape of the grains, the grain size and the grain size distribution. All the silver halide grains constituting the emulsion were cubic and had a mean grain size of 0.52 μm and a fluctuation coefficient of 0.08. The mean grain size was represented by the mean value of the diameter of a circle equivalent to the projected area of each grain; and the grain size distribution was represented by the value obtained by dividing the standard deviation of the respective grain sizes by the mean grain size.

Next, by measuring X-ray diffraction from the silver halide crystals constituting the emulsion formed, the halogen composition of the emulsion grains was determined. Briefly, a monochromaticized CuKα ray was used as a ray source, and the diffracted angle from (200) plane was measured in detail. The diffracted line from a crystal having a uniform halogen composition gives a single peak, while the diffracted line from a crystal having a localized phase with a different composition gives a plurality peaks each corresponding to the respective compositions. From the diffracted angle thus measured, the lattice constant was calculated, on the basis of which the halogen composition of the silver halide constituting the crystal was determined. The result of determining the silver chlorobromide emulsion (A) in this way indicated that the emulsion had a main peak for 100% silver chloride along with an additional broad diffraction pattern having a center at 70% silver chloride (30% silver bromide) with an extending skirt to about 60% silver chloride (40% silver bromide).

Formation of Photographic Material Sample (a):

One surface of a paper support laminated with polyethylene on both surfaces thereof was corona-discharged, and a gelatin subbing layer containing sodium dodecylbenzenesulfonate was provided thereon. In addition, a plurality photographic layers were coated thereover to form a multilayer color photographic paper sample having the layer constitution mentioned below was prepared. Coating compositions were prepared in the manner described below.

Preparation of Coating Composition for First Layer 27.2 cc of ethyl acetate, 4.1 g of solvent (Solv- 3) and 4.1 g of solvent (Solv-7) were added to 19.1 g of yellow coupler (ExY), 4.4 g of color image stabilizer (Cpd-1) and 0.7 g of color image stabilizer (Cpd-7), and dissolved. The resulting solution was added to 185 cc of an aqueous 10% gelatin solution containing 8 cc of an aqueous 10% sodium dodecylbenzenesulfonate solution and emulsified and dispersed to obtain an emulsified dispersion. On the other hand, an emulsion was prepared by adding the following red-sensitizing dye (Dye-1) to the silver chlorobromide emulsion (A). The previous emulsified dispersion and the resulting emulsion were blended to obtain a coating liquid for the first layer, having the composition mentioned below.

Other coating liquids for the second layer to seventh layer were prepared in the same manner as above. The gelatin hardening agent for each layer was 1-hydroxy- 3,5-dichloro-s-triazine sodium salt.

Cpd-10 and Cpd-11 were added to each layer in a total amount of 25.0 mg/m2 and 50.0 mg/m2, respectively. The following color sensitizing dyes were used for the respective layers.

First Layer: Red-sensitive Yellow Coloring Layer

Dye-1:

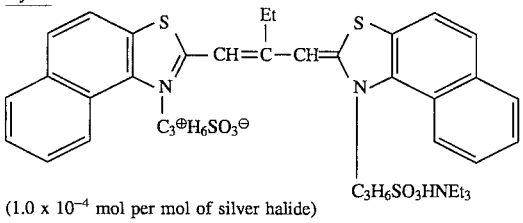

(1.0 x $10^{-4}$ mol per mol of silver halide)

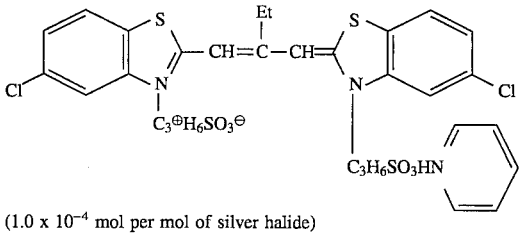

(1.0 x $10^{-4}$ mol per mol of silver halide)

Third Layer: Infrared-sensitive Magenta Coloring Layer

Dye-2:

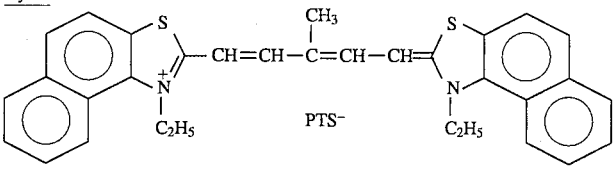

(4.5 x $10^{-4}$ mol per mol of silver halide)

-continued

Fifth Layer: Infrared-sensitive Cyan Coloring Layer

Dye-3:

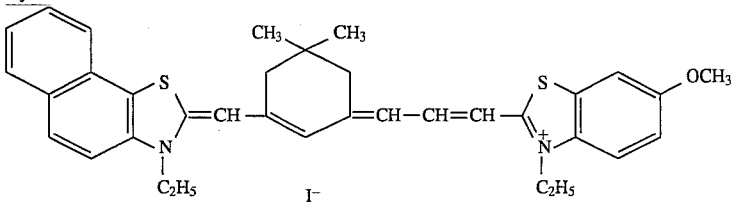

(0.5 x $10^{-5}$ mol per mol of silver halide)

Where Dye-2 and Dye-3 were used, the following compound was added in an amount of $1.8\times10^{-3}$ mol per mol of silver halide.

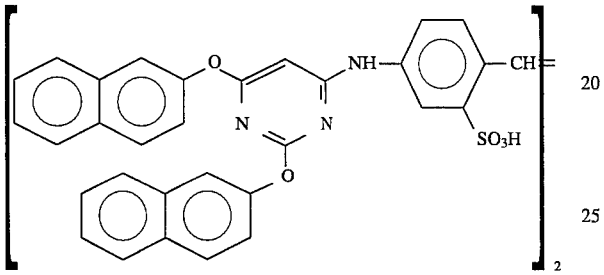

In addition, $8.0\times10^{-4}$ mol, per mol of silver halide, of 1-(5-methylureidophenyl)-5-mercaptotetrazole was added to each of the yellow coloring emulsion layer, magenta coloring emulsion layer and cyan coloring emulsion layer.

For the purpose of anti-irradiation, the following dyes were added to the emulsion layer.

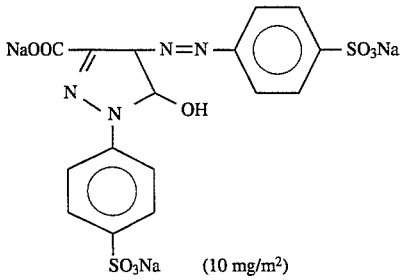

(10 mg/m²)

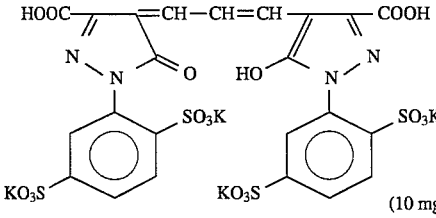

(10 mg/m²)

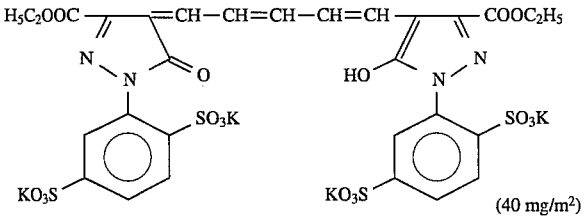

(40 mg/m²)

and

-continued

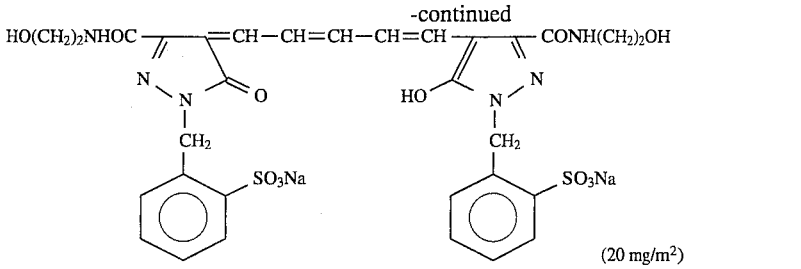

(20 mg/m²)

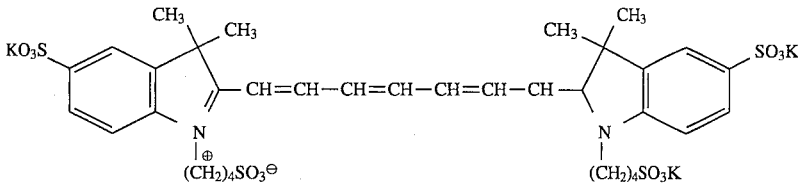

(10 mg/m²)

and

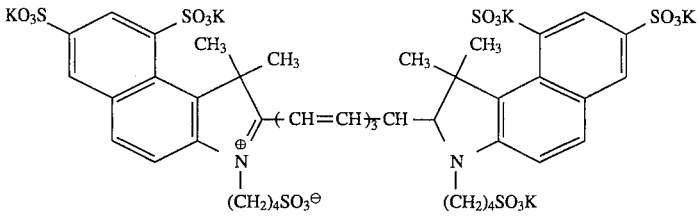

(5 mg/m²)

and

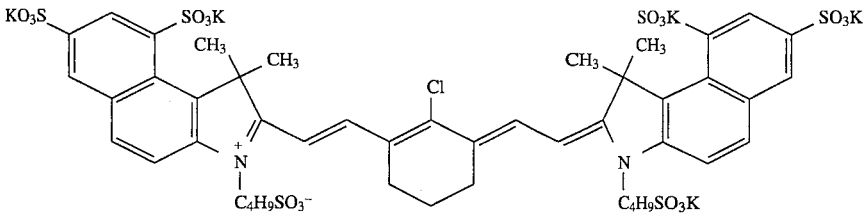

(5 mg/m²)

Constitution of Layers

Compositions of the constituent layers are shown below. The number indicates the amount coated as a unit of g/m². The amount of silver halide emulsion coated is represented by the amount of silver therein.

| | |
|---|---|
| Support: | |
| Polyethylene-laminated Paper (containing white pigment ($TiO_2$) and bluish dye (ultramarine) in polyethylene below the first layer) | |
| First Layer: Red-sensitive Yellow Coloring Layer | |
| Above-mentioned Silver Chlorobromide Emulsion (A) | 0.30 |
| Gelatin | 1.86 |
| Yellow Coupler (ExY) | 0.82 |
| Color Image Stabilizer (Cpd-1) | 0.19 |
| Solvent (Solv-3) | 0.18 |
| Solvent (Solv-7) | 0.18 |
| Color Image Stabilizer (Cpd-7) | 0.06 |
| Second Layer: Color Mixing Preventing Layer | |
| Gelatin | 0.99 |

-continued

| | |
|---|---|
| Color Mixing Preventing Agent (Cpd-5) | 0.08 |
| Solvent (Solv-1) | 0.16 |
| Solvent (Solv-4) | 0.08 |
| Third Layer: Infrared-sensitive Magenta Coloring Layer | |
| Silver Chlorobromide Emulsion (A) | 0.12 |
| Gelatin | 1.24 |
| Magenta Coupler (ExM) | 0.23 |
| Color Image Stabilizer (Cpd-2) | 0.03 |
| Color Image Stabilizer (Cpd-3) | 0.16 |
| Color Image Stabilizer (Cpd-4) | 0.02 |
| Color Image Stabilizer (Cpd-9) | 0.02 |
| Solvent (Solv-2) | 0.40 |
| Fourth Layer: Ultraviolet Absorbing Layer | |
| Gelatin | 1.58 |
| Ultraviolet Absorbent (UV-1) | 0.47 |
| Color Mixing Preventing Agent (Cpd-5) | 0.05 |
| Solvent (Solv-5) | 0.24 |
| Fifth Layer: Infrared-sensitive Cyan Coloring Layer | |
| Silver Chlorobromide Emulsion (A) | 0.23 |
| Gelatin | 1.34 |
| Cyan Coupler (ExC) | 0.32 |
| Color Image Stabilizer (Cpd-2) | 0.03 |
| Color Image Stabilizer (Cpd-4) | 0.02 |

-continued

| | |
|---|---|
| Color Image Stabilizer (Cpd-6) | 0.18 |
| Color Image Stabilizer (Cpd-7) | 0.40 |
| Color Image Stabilizer (Cpd-8) | 0.05 |
| Solvent (Solv-6) | 0.14 |
| Sixth Layer: Ultraviolet Absorbing Layer | |
| Gelatin | 0.53 |
| Ultraviolet Absorbent (UV-1) | 0.16 |
| Color Mixing Preventing Agent (Cpd-5) | 0.02 |
| Solvent (Solv-5) | 0.08 |

-continued

| | |
|---|---|
| Seventh Layer: Protecting Layer | |
| Gelatin | 1.33 |
| Acrylic-modified Copolymer of Polyvinyl Alcohol (modification degree 17%) | 0.17 |
| Liquid Paraffin | 0.03 |

The compounds used above are shown below.

(ExY) Yellow Coupler:
1/1 (by mol) mixture of the following compounds:

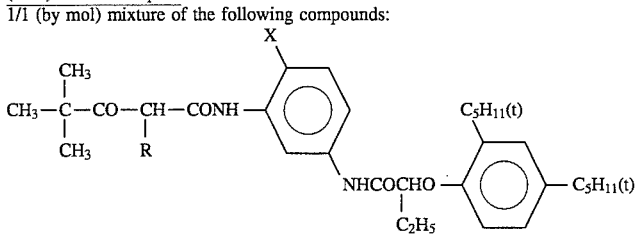

R =

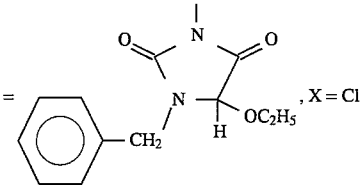

, X = Cl and

R =

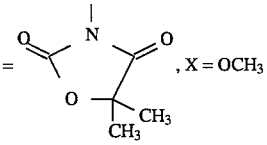

, X = $OCH_3$ (ExM) Magenta Coupler:

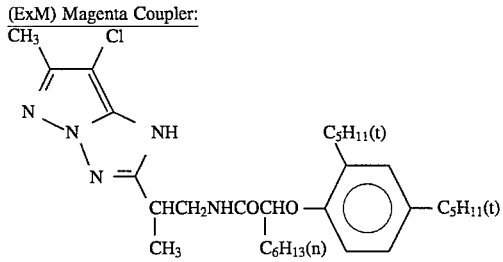

(ExC) Cyan Coupler:
1/1 (by mol) mixture of the following compounds:

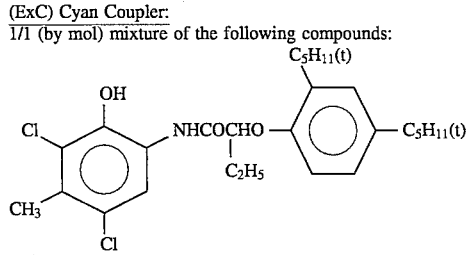

and

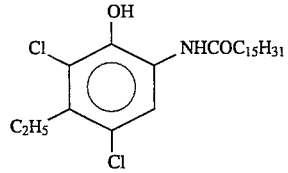

-continued
(Cpd-1) Color Image Stabilizer:
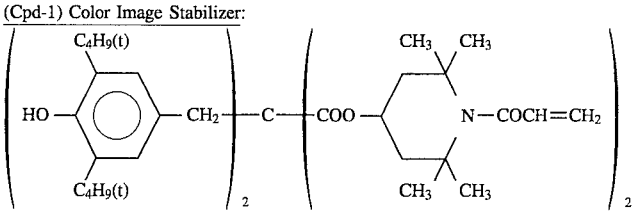
(Cpd-2) Color Image Stabilizer:
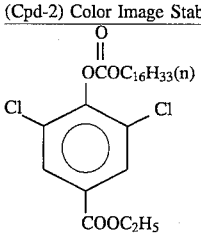
(Cpd-3) Color Image Stabilizer:
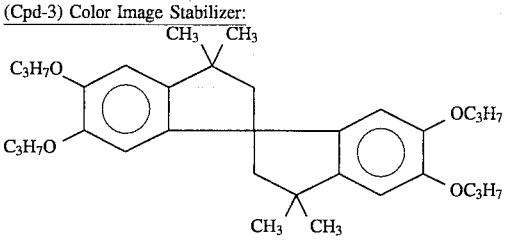
(Cpd-4) Color Image Stabilizer:
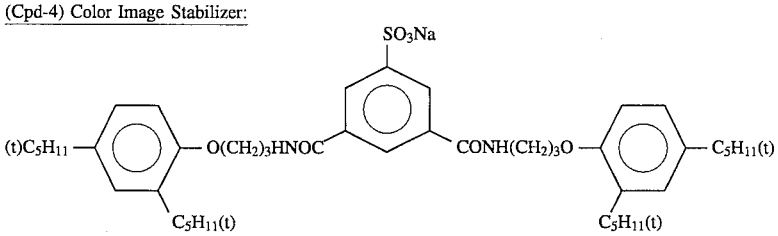
(Cpd-5) Color Mixing Preventing Agent:
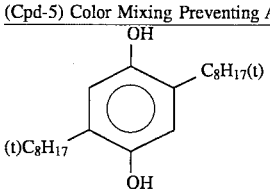
(Cpd-6) Color Image Stabilizer:
2/4/4 (by weight) mixture of the following compounds:
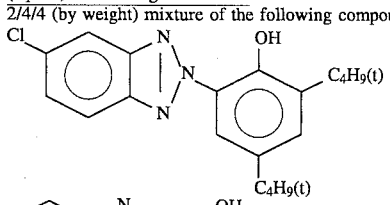
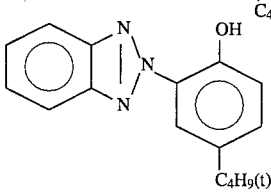

-continued
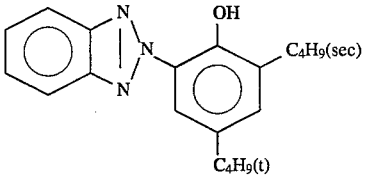
(Cpd-7) Color Image Stabilizer:
$$\left(CH_2-\underset{\underset{CONHC_4H_9(n)}{|}}{CH}\right)_n$$
(mean molecular weight 60,000)
(Cpd-8) Color Image Stabilizer:
1/1 (by weight) mixture of the following compounds:
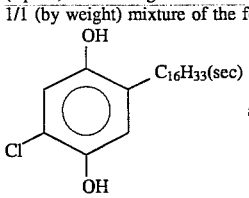
and
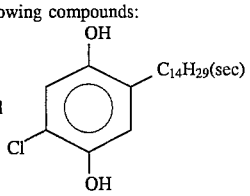
(Cpd-9) Color Image Stabilizer:
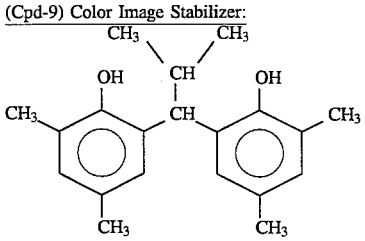
(Cpd-10) Antiseptic:
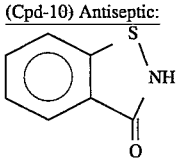
(Cpd-11) Antiseptic:
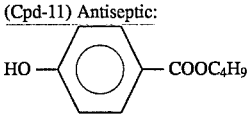
(UV-1) Ultraviolet Absorbent:
4/2/4 (by weight) mixture of the following compounds:
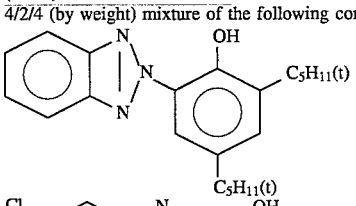
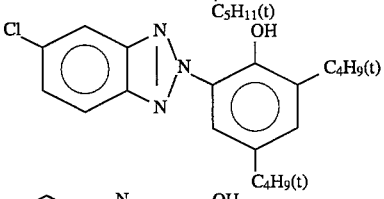
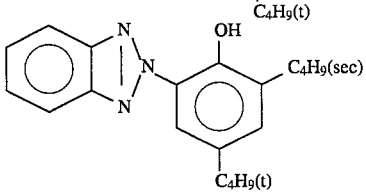

-continued (Solv-1) Solvent:

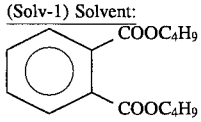

(Solv-2) Solvent:
1/1 (by volume) mixture of the following compounds:

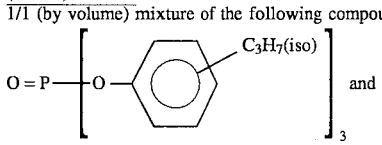

and

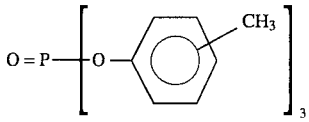

(Solv-3) Solvent:
$O=P+O-C_9H_{19}(iso)]_3$ (Solv-4) Solvent:

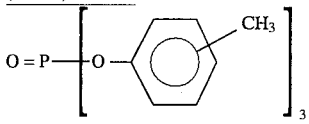

(Solv-5) Solvent:

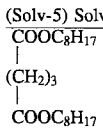

(Solv-6) Solvent:
80/20 (by volume) mixture of the following compounds:

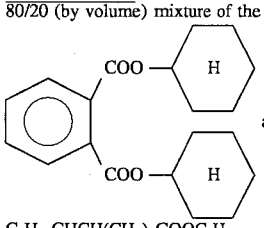

and

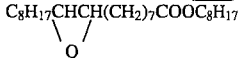

(Solv-7) Solvent:

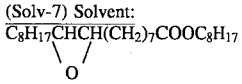

The samples shown in Table 2 below have the same layer constitution as Sample (a) prepared above, except that, in Samples Nos. 1 and 2, the color sensitizing dye in the first layer (yellow coloring layer) was replaced by the dye shown in Table 2; in Samples Nos. 3 to 8, the color sensitizing dye in the third layer (magenta coloring layer) was replaced by the dye shown in Table 2; and in Samples Nos. 9 to 18, the color sensitizing dye in the fifth layer (cyan coloring layer) was replaced by the dye shown in Table 2.

TABLE 2

| | Sensitizing Dye Added | | Stored in argon at −30° C. | | Stored under 80% RH and 50° C. for 3 days | | Stored in oxygen partial pressure of 10 atms, for 7 days | |
|---|---|---|---|---|---|---|---|---|
| Sample No. | Compound | Amount ($\times 10^{-5}$ mol/mol-Ag) | Relative Sensitivity | Fog | Relative Sensitivity | Fog | Relative Sensitivity | Remarks |
| 1 | C-1 | 1.1 | 100 (standard) | 0.03 | 90 | 0.05 | 87 | comparative sample |
| 2 | 6 | 1.1 | 102 | 0.03 | 98 | 0.05 | 93 | sample of the |

TABLE 2-continued

| Sample No. | Sensitizing Dye Added: Compound | Sensitizing Dye Added: Amount ($\times 10^{-5}$ mol/mol-Ag) | Stored in argon at −30° C.: Relative Sensitivity | Stored in argon at −30° C.: Fog | Stored under 80% RH and 50° C. for 3 days: Relative Sensitivity | Stored under 80% RH and 50° C. for 3 days: Fog | Stored in oxygen partial pressure of 10 atms, for 7 days: Relative Sensitivity | Remarks |
|---|---|---|---|---|---|---|---|---|
| | | | | | | | | invention |
| 3 | C-2 | 1.1 | 100 (standard) | 0.03 | 73 | 0.04 | 65 | comparative sample |
| 4 | 8 | 1.1 | 103 | 0.03 | 93 | 0.04 | 82 | sample of the invention |
| 5 | C-3 | 1.1 | 100 | 0.04 | 72 | 0.04 | 64 | comparative sample |
| 6 | 9 | 1.1 | 105 | 0.04 | 92 | 0.04 | 82 | sample of the invention |
| 7 | C-4 | 1.1 | 111 | 0.04 | 76 | 0.05 | 61 | comparative sample |
| 8 | 10 | 1.1 | 117 | 0.04 | 91 | 0.04 | 82 | sample of the invention |
| 9 | C-5 | 1.0 | 100 (standard) | 0.03 | 75 | 0.04 | 57 | comparative sample |
| 10 | 19 | 1.0 | 101 | 0.03 | 96 | 0.03 | 85 | sample of the invention |
| 11 | C-6 | 1.0 | 103 | 0.03 | 65 | 0.03 | 55 | comparative sample |
| 12 | 20 | 1.0 | 105 | 0.03 | 92 | 0.03 | 83 | sample of the invention |
| 13 | C-7 | 1.0 | 100 | 0.03 | 62 | 0.05 | 40 | comparative sample |
| 14 | 21 | 1.0 | 102 | 0.03 | 88 | 0.03 | 65 | sample of the invention |
| 15 | C-8 | 1.0 | 105 | 0.03 | 70 | 0.04 | 53 | comparative sample |
| 16 | 23 | 1.0 | 107 | 0.03 | 91 | 0.03 | 85 | sample of the invention |
| 17 | C-9 | 1.0 | 97 | 0.03 | 66 | 0.04 | 49 | comparative sample |
| 18 | 29 | 1.0 | 102 | 0.03 | 85 | 0.03 | 82 | sample of the invention |

The comparative sensitizing dyes used above are shown below:

C-1

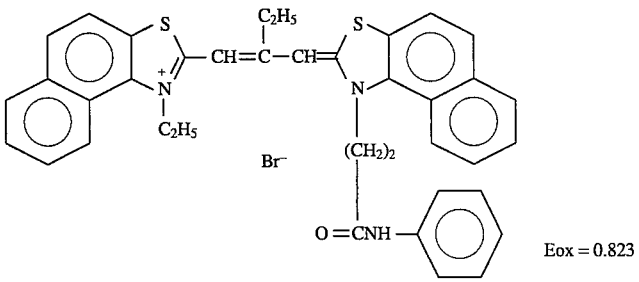

Eox = 0.823

C-2

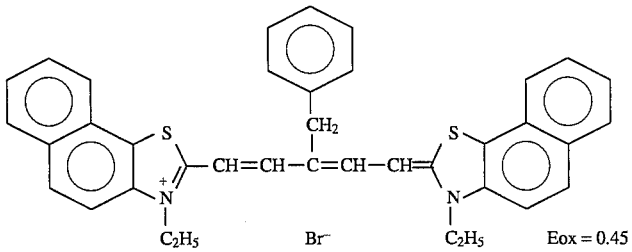

Eox = 0.45

-continued
C-3
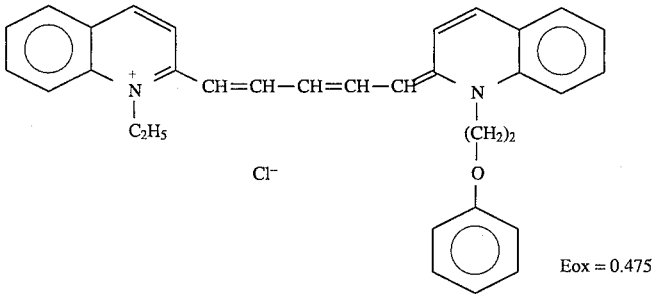
Eox = 0.475
C-4
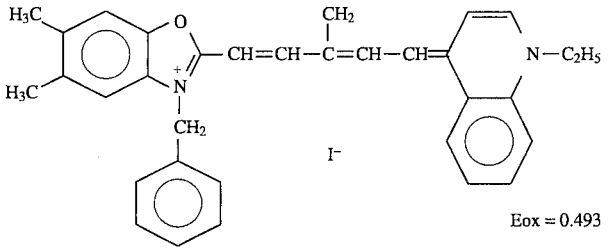
Eox = 0.493
C-5
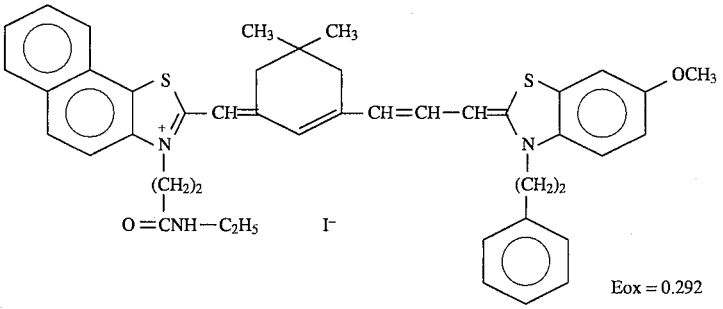
Eox = 0.292
C-6
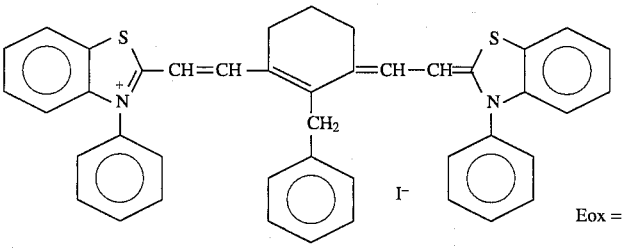
Eox = 0.292
C-7
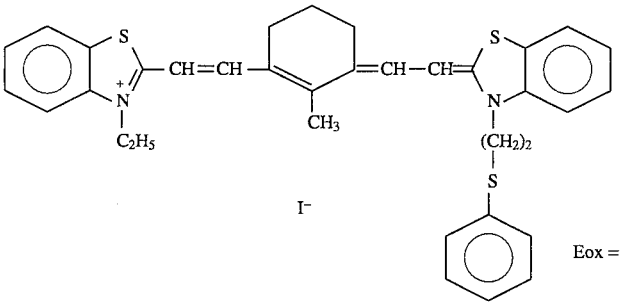
Eox = 0.253

-continued

C-8

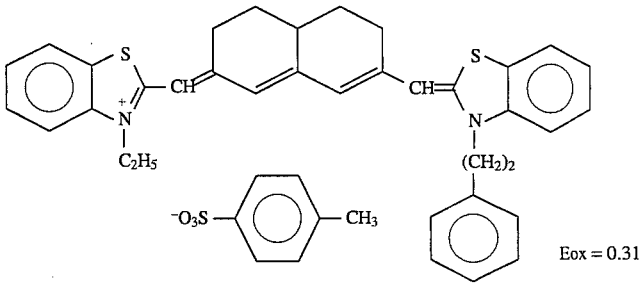

Eox = 0.31

C-9

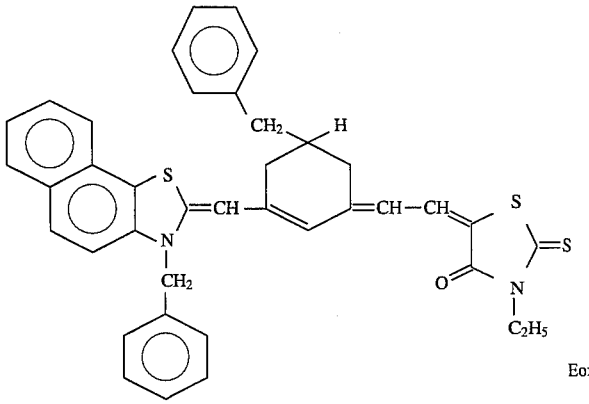

Eox = 0.31

The coated samples were divided into three groups. The first group was put and hermetically sealed in an oxygen-impermeable bag, the inside atmosphere was substituted by argon, and stored at −30° C. The second group was stored under 80% RH and 50° C. for 3 days. The third group was stored under an oxygen partial pressure of 10 atms at room temperature for 7 days.

These samples were then exposed, using the following two exposing devices:

(1) A sensitometer (FWH Model, manufactured by Fuji Photo Film Co.; color temperature of light source, 3200° K.) was used. Each sample was sensitometrically wedgewise exposed with the sensitometer for 10 seconds, via deposition interference filters of 670 nm, 750 nm and 830 nm.

(2) Semiconductor lasers AlGaInP (oscillating wavelength, about 670 nm), GaAlAs (oscillating wavelength, about 750 nm) and GaAlAs (oscillating wavelength, about 830 nm) were used. Samples to be exposed were applied to the semiconductor laser device, in which laser rays were applied to each sample for scanning exposure from a rotating polyhedral element and each sample to be exposed was moved vertically to the scanning direction. While exposing the samples with the device, the quantity of light applied to each sample was varied, whereupon the relation between the density (D) of the sample and the quantity of light (E) was obtained as D-logE. The quantity of light of the semiconductor laser applied to each sample was controlled by combination of a pulse modulation system by which the time of electrically charging the laser device was varied to modulate the quantity of light and an intensity modulation system by which the amount of electric charge imparted to the laser device was varied to modulate the quantity of light, whereby the exposure amount of each sample was controlled. The scanning exposure was effected at 400 dpi, whereupon the mean exposure time per pixel was about $10^{-7}$ second.

After exposure, the exposed samples were processed in the manner described below.

Development of Exposed Samples

Using a paper processing machine, the exposed samples were continuously processed (running processing) in accordance with the process described below, until the amount of the replenisher to the color developer tank was two times of the capacity of the tank. Then, the samples were processed with the processing system after the running test.

| Processing Steps | Temperature | Time | Replenisher (*) | Capacity of Tank |
|---|---|---|---|---|
| Color Development | 35° C. | 45 sec | 161 ml | 17 liters |
| Bleach-fixation | 30 to 35° C. | 45 sec | 215 ml | 17 liters |
| Rinsing (1) | 30 to 35° C. | 20 sec | — | 10 liters |
| Rinsing (2) | 30 to 35° C. | 20 sec | — | 10 liters |
| Rinsing (3) | 30 to 35° C. | 20 sec | 350 ml | 10 liters |
| Drying | 70 to 80° C. | 60 sec | | |

(*) Amount of replenisher is per $m^2$ of sample being processed.

(Rinsing was effected by three-tank countercurrent system from rinsing tank (3) to rinsing tank (1).)

The processing solutions used in the above-mentioned steps had the following compositions.

| Color Developer | Tank Solution | Replenisher |
|---|---|---|
| Water | 800 ml | 800 ml |
| Ethylenediamine-N,N,N',N'-tetra-methylenephosphonic Acid | 1.5 g | 2.0 g |
| Potassium Bromide | 0.015 g | — |
| Triethanolamine | 8.0 g | 12.0 g |
| Sodium Chloride | 1.4 g | — |

-continued

| | | |
|---|---|---|
| Potassium Carbonate | 25 g | 25 g |
| N-ethyl-N-(β-methanesulfonamido-ethyl)-3-methyl-4-aminoaniline Sulfate | 5.0 g | 7.0 g |
| N,N-bis(carboxymethyl)hydrazine | 4.0 g | 5.0 g |
| N,N-di(sulfoethyl)hydroxylamine.1Na | 4.0 g | 5.0 g |
| Brightening Agent (WHITEX 4B, product by Sumitomo Chemical Co.) | 1.0 g | 2.0 g |
| Water to make | 1000 ml | 1000 ml |
| pH (25° C.) | 10.05 | 10.45 |

Bleach-fixing Solution:
(Tank solution and replenisher were same.)

| | |
|---|---|
| Water | 400 ml |
| Ammonium Thiosulfate (70 g/l) | 100 ml |
| Sodium Sulfite | 17 g |
| Ammonium Ethylenediaminetetraacetato Ferrate | 55 g |
| Disodium Ethylenediaminetetraacetate | 5 g |
| Ammonium Bromide | 40 g |
| Water to make | 1000 ml |
| pH (25° C.) | 6.0 |

Rinsing Solution (Tank solution and replenisher were same.)

Ion-exchanged Water (having calcium content of 3 ppm or less and magnesium content of 3 ppm or less).

The results obtained are shown in Table 2 above. The sensitivity indicates the result as measured with the sensitometer. When the semiconductor lasers were used, the same results were obtained. The sensitivity is represented by a reciprocal of the amount of exposure necessary for coloring the sample to have a density composed of the coupler coloring density 0.5 plus the fog density.

The sensitivity of Sample No. 2 as stored in argon at −30° C. was represented by a relative sensitivity based on the sensitivity of Sample No. 1 being 100 (standard). The sensitivity of Samples Nos. 4 to 8 stored in argon at −30° C. is represented by a relative sensitivity based on the sensitivity of Sample No. 3 of being 100 (standard); and that of Samples 10 to 18 stored in the same is represented by a relative sensitivity based on the sensitivity of Sample No. 9 being 100 (standard).

The sensitivity of each sample as stored under the conditions of 85% RH and 50° C. or under the condition of an oxygen partial pressure of 10 atms is represented by a relative sensitivity based on the sensitivity of each sample in argon (−30° C.) being 100 (standard).

EXAMPLE 2

The same samples as those in Example 1 were processed with the same automatic developing machine in accordance with the process (II) described below, and the processed samples were tested in the same manner as in Example 1. The same results as those in Example 1 were obtained.

Development Process (II) of Photographic Material Samples

Using the same automatic developing machine as that used in Example 1, the samples were processed in accordance with the following process (II).

Development Process (II)

| Processing Steps | Temperature | Time |
|---|---|---|
| Color Development | 38° C. | 20 sec |
| Bleach-fixation | 38° C. | 20 sec |
| Rinsing (1) | 38° C. | 7 sec |
| Rinsing (2) | 38° C. | 7 sec |
| Rinsing (3) | 38° C. | 7 sec |
| Rinsing (4) | 38° C. | 7 sec |
| Rinsing (5) | 38° C. | 7 sec |
| Drying | 65° C. | 15 sec |

Rinsing was effected by a five-tank countercurrent system from rinsing tank (5) to rinsing tank (1).

The processing time for each step in the abovementioned process (II) indicates the time from introduction of the sample being processed into one processing bath to introduction of the same to the next processing bath, including the blank time between the two baths. The proportion of the blank time to the processing time varies, generally depending upon the size of the processing machine. In the present example, the proportion was within the range of from 5% to 40%.

The processing solutions used in the abovementioned steps had the following compositions:

| Color Developer | Tank Solution | Replenisher |
|---|---|---|
| Water | 700 ml | 700 ml |
| Sodium Triisopropylnaphthalene-(β)sulfonate | 0.1 g | 0.1 g |
| Ethylenediaminetetraacetic Acid | 3.0 g | 3.0 g |
| Disodium 1,2-Dihydroxybenzene-4,6-disulfonate | 0.5 g | 0.5 g |
| Triethanolamine | 12.0 g | 12.0 g |
| Potassium Chloride | 6.5 g | no |
| Potassium Bromide | 0.03 g | no |
| Sodium Sulfite | 0.1 g | 0.1 g |
| Potassium Carbonate | 27.0 g | 27.0 g |
| 4-Amino-N-ethyl-N-(3-hydroxy-propyl)-3-methylaniline | 12.8 g | 27.8 g |
| Disodium N,N-bis(sulfonatoethyl)-hydroxylamine | 10.0 g | 13.0 g |
| Brightening Agent (UVITEX-CK, by Ciba-Geigy) | 2.0 g | 6.0 g |
| Water to make | 1000 ml | 1000 ml |
| pH (25° C.) | 10.05 | 10.95 |

The amount of the replenisher to the color developer bath was 35 ml per m2 of the photographic material sample being processed.

| Bleach-fixing Solution: | Tank Solution | Replenisher |
|---|---|---|
| Water | 400 ml | 400 ml |
| Ammonium Thiosulfate (70%) | 100 ml | 250 ml |
| Ethylenediaminetetraacetic Acid | 3.4 g | 8.5 g |
| Ammonium Ethylenediamine-tetraacetato Ferrate Dehydrate | 73.0 g | 183 g |
| Ammonium Sulfite | 40 g | 100 g |
| Ammonium Bromide | 20.0 g | 50.0 g |
| Nitric Acid (67%) | 9.6 g | 24 g |
| Water to make | 1000 ml | 1000 ml |
| pH (25° C.) | 5.80 | 5.10 |

The amount of the replenisher to the bleach-fixing bath was 35 ml per m2 of the photographic material sample being processed.

Rinsing Solution

Ion-exchanged water was used as both the tank solution and the replenisher; and the amount of the replenisher to the bath was 60 ml/m$^2$.

EXAMPLE 3

The same test as that in Example 1 was repeated, using the same photographic material samples and the same automatic developing machine, except that the samples were processed in accordance with the process (III) described below. The same results as those in Example 1 were obtained.

Development Process (III) of Photographic Material Samples:

| Processing Steps | Temp. | Time | Amount of Replenisher per m$^2$ of Sample |
|---|---|---|---|
| Color Development | 38.5° C. | 45 sec | 35 ml |
| Bleach-fixation | 38° C. | 20 sec | 35 ml |
| Rinsing (1) | 38° C. | 12 sec | |
| Rinsing (2) | 38° C. | 12 sec | |
| Rinsing (3) | 38° C. | 12 sec | 105 ml |
| Drying | 65° C. | 15 sec | |

Rinsing was effected by a three-tank countercurrent system from rinsing tank (3) to rinsing tank (1).

The processing solutions used in the abovementioned steps had the following compositions:

| Color Developer | Tank Solution | Replenisher |
|---|---|---|
| Water | 700 ml | 700 ml |
| Sodium Triisopropylnaphthalene (β)sulfonate | 0.1 g | 0.1 g |
| Ethylenediaminetetraacetic Acid | 3.0 g | 3.0 g |
| Disodium 1,2-Dihydroxybenzene-4,6-disulfonate | 0.5 g | 0.5 g |
| Triethanolamine | 12.0 g | 12.0 g |
| Potassium Chloride | 6.5 g | no |
| Potassium Bromide | 0.03 g | no |
| Potassium Carbonate | 27.0 g | 27.0 g |
| Sodium Sulfite | 0.1 g | 0.1 g |
| Disodium N,N-bis(sulfonato-ethyl)hydroxylamine | 10.0 g | 13.0 g |
| N-ethyl-N-(β-methanesulfon-amidoethyl)-3-methyl-4-amino-aniline Sulfate | 5.0 g | 11.5 g |
| Brightening Agent (UVITEX-CK, by Ciba-Geigy) | 2.0 g | 6.5 g |

EXAMPLE 4

A compound as indicated in Table 3 below was added, at 40° C. to a tabular silver iodobromide emulsion (mean diameter, 0.82 μm; mean aspect ratio of diameter/thickness, 11.2; pAg 8.2; pH 6.5) prepared in accordance with the method described in Example 1 of JP-A-60-131533, the emulsion having been sensitized by gold/sulfur sensitization; and as a gelatin hardening agent, sodium salt of 2,4-dichloro-6-hydroxy-1,3,5-triazine was added thereto. The resulting composition was coated on a cellulose triacetate support to form an emulsion layer thereon, whereon a protecting layer containing gelatin and containing a surfactant and the above-mentioned gelatin hardening agent was simultaneously coated over the emulsion layer.

Samples thus coated were divided into three groups. The first group was stored at −30° C. for one year and the second group was under the atmospheric condition for one year. The third group was stored at −30° C. and then stored under the conditions of 80% RH and 50° C. for the last three days before exposure. All the groups of the samples were sensitometrically exposed with a sensitometer (FWH Model, manufactured by Fuji Photo Film Co.; equipped with ultraviolet absorbing filter and tungsten light source with color temperature of 2854° K.) through a sharp-cut filter transmitting a light having a longer wavelength than 520 nm. The exposed samples were then developed with the developer described below and bleached, rinsed in water and dried.

The thus processed samples were measured with a densitometer (manufactured by Fuji Photo Film Co.) to determine the fog density and the sensitivity. The sensitivity is represented by the reciprocal of the quantity of light necessary for giving a density of (fog density +0.2). The results obtained are shown in Table 3 below, where the sensitivity is represented by a relative value to the standard sensitivity (100) of each sample stored at −30° C.

Composition of Developer:

| | |
|---|---|
| Metol | 2.5 g |
| 1-Ascorbic Acid | 10.0 g |
| Potassium Bromide | 1.0 g |
| Nabox | 35.0 g |
| Water to make | 1.0 liter (pH 9.8) |

As is noted from the results in Table 3 below, the increase or decrease of the sensitivity of the samples of the present invention during and after storage of them is little. Comparing the samples of containing polymethine dyes C-12, C-13, (18) and (24), which have a smaller Eox value than 0.60 VvsSCE, and the samples of containing polymethine dyes C-10, C-11 and (3), which have a larger Eox value than 0.60 VvsSCE, the decrease of the sensitivity (desensitization) of the former samples is larger than that of the latter samples. The desensitization is especially noticeable in the samples of containing C-12 and C-13. The degree of desensitization of the samples of containing the polymethine dyes of the present invention was smaller than that of the comparative samples of containing C-12 and C-13. Thus, the superiority of the present invention to the related prior art is apparent.

TABLE 3

| | Polymethine Dye Added | | Stored at −30° C. | | Stored under 80% RH and 50° C. for 3 days | | Stored under Atmospheric Condition for 1 year | | |
|---|---|---|---|---|---|---|---|---|---|
| Sample No. | Compound | Amount (× 10$^{-5}$ mol/mol-Ag) | Sensitivity (standard) | Fog | Relative Sensitivity | Fog | Relative Sensitivity | Fog | Remarks |
| 1-1 | C-10 | 70 | 100 | 0.02 | 94 | 0.02 | 93 | 0.02 | comparative sample |
| 1-2 | C-11 | 70 | 100 | 0.02 | 97 | 0.02 | 95 | 0.02 | comparative |

TABLE 3-continued

| Sample No. | Polymethine Dye Added: Compound | Polymethine Dye Added: Amount ($\times 10^{-5}$ mol/mol-Ag) | Stored at −30° C.: Sensitivity (standard) | Stored at −30° C.: Fog | Stored under 80% RH and 50° C. for 3 days: Relative Sensitivity | Stored under 80% RH and 50° C. for 3 days: Fog | Stored under Atmospheric Condition for 1 year: Relative Sensitivity | Stored under Atmospheric Condition for 1 year: Fog | Remarks |
|---|---|---|---|---|---|---|---|---|---|
| | | | | | | | | | sample |
| 1-3 | 3 | 70 | 100 | 0.02 | 100 | 0.02 | 99 | 0.02 | sample of the invention |
| 1-4 | C-12 | 1.0 | 100 | 0.02 | 64 | 0.04 | 53 | 0.03 | comparative sample |
| 1-5 | C-13 | 1.0 | 100 | 0.02 | 80 | 0.03 | 67 | 0.02 | comparative sample |
| 1-6 | 18 | 1.0 | 100 | 0.02 | 94 | 0.02 | 84 | 0.02 | sample of the invention |
| 1-7 | 24 | 1.0 | 100 | 0.02 | 97 | 0.02 | 78 | 0.02 | sample of the invention |

The comparative compounds used above are shown below:

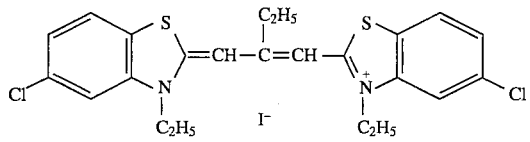

C-10

Eox = 0. 935

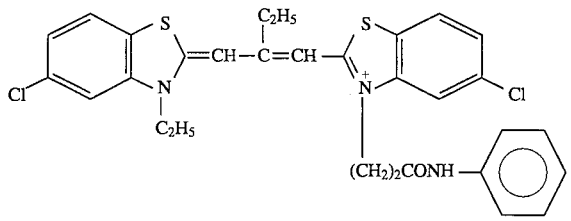

C-11

Eox = 0. 936

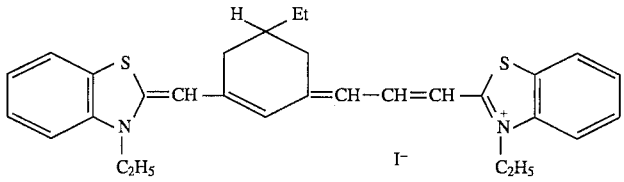

C-12

Eox = 0. 374

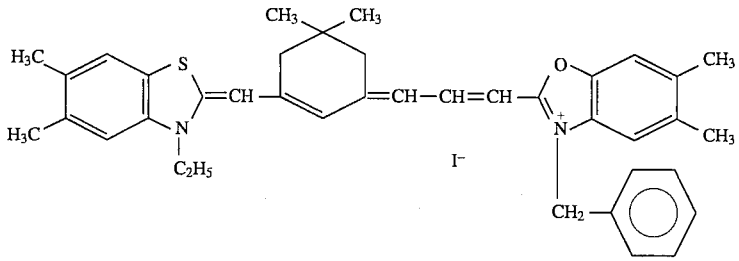

C-13

Eox = 0. 315

EXAMPLE 5

A cubic silver bromide emulsion was prepared in accordance with the method of Example 1 of JP-A-1-223441. The silver bromide grains in the emulsion prepared were monodisperse having a mean side length of 0.74 μm and having a fluctuation coefficient of 10.6%. The emulsion was adjusted to have a pH of 6.3 and a pAg of 8.4 at 40° C. and ripened with chloroauric acid and sodium thiosulfate for optimum gold/sulfur sensitization.

Next, a compound as indicated in Table 4 below was added thereto at 40° C.; and 0.1 g, per kg of emulsion, of sodium 2-hydroxy-4,6-dichloro-1,3,5-triazine and 0.1 g, per kg of emulsion, of sodium dodecylbenzenesulfonate were added thereto. The resulting composition was coated on a polyethylene terephthalate film base along with a protecting layer, in the same manner as in Example 4.

The coated samples thus prepared were divided into three groups. The first group was stored at −30° C. for 3 days, the second group was stored under the conditions of 80% RH and 50° C. for 3 days, and the third group was stored under the condition of an oxygen partial pressure of 10 atms at room temperature for 3 days. The thus stored samples were then sensitometrically exposed and then developed in the same manner as in Example 4, and the sensitivity of each of the processed samples was determined. The sensitivity was represented by the reciprocal of the quantity of light needed for giving a density of (fog density + 0.2). The results obtained are shown in Table 4 below, in which the sensitivity of each sample is represented by the relative value to the sensitivity (100, as standard) of each sample stored at −30° C.

TABLE 4

| | Dye(s) Added | | Relative Sensitivity | | | |
|---|---|---|---|---|---|---|
| Sample No. | Compound(s) | Amount ($\times 10^{-4}$ mol/mol-Ag) | Stored at −30° C. (standard) | Stored at 80% RH and 50° C. for 3 days | Stored under oxygen partial pressure of 10 atms for 3 days | Remarks |
| 2-1 | C-14 | 0.45 | 100 | 33 | 45 | comparative sample |
| 2-2 | 12 | 0.45 | 100 | 75 | 77 | sample of the invention |
| 2-3 | 12<br>V-1 | 0.45<br>3.0 | 100 | 91 | 78 | sample of the invention |
| 2-4 | C-15 | 0.05 | 100 | 67 | 47 | comparative sample |
| 2-5 | C-15<br>V-2 | 0.05<br>3.0 | 100 | 81 | 49 | comparative sample |
| 2-6 | 18 | 0.05 | 100 | 88 | 73 | sample of the invention |
| 2-7 | 18<br>V-2 | 0.05<br>3.0 | 100 | 97 | 76 | sample of the invention |
| 2-8 | C-16 | 0.07 | 100 | 72 | 36 | comparative sample |
| 2-9 | C-16 | 0.07 | 100 | 88 | 61 | comparative sample |
| 2-10 | 22 | 0.07 | 100 | 87 | 73 | sample of the invention |
| 2-11 | 22<br>IV-1 | 0.07<br>3.4 | 100 | 97 | 90 | sample of the invention |

The comparative compounds used above are shown below:

C-14

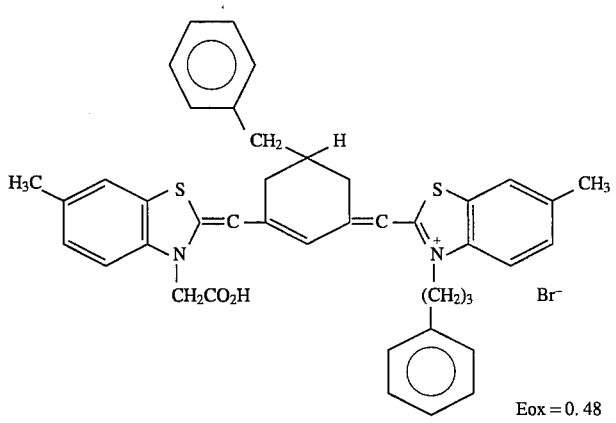

Eox = 0. 48

-continued

C-15

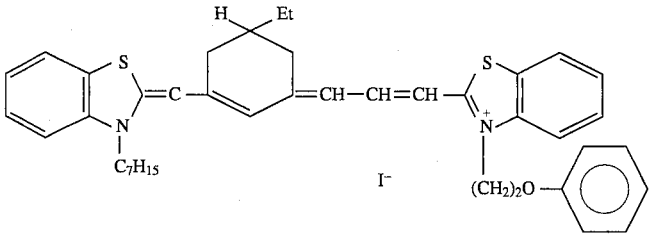

Eox = 0. 372

C-16

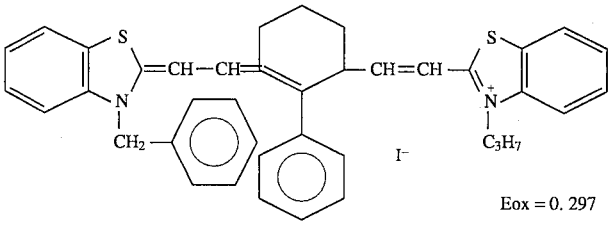

Eox = 0. 297

V-1

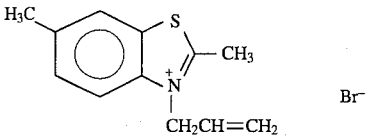

V-2

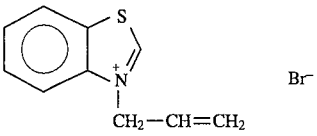

IV-1

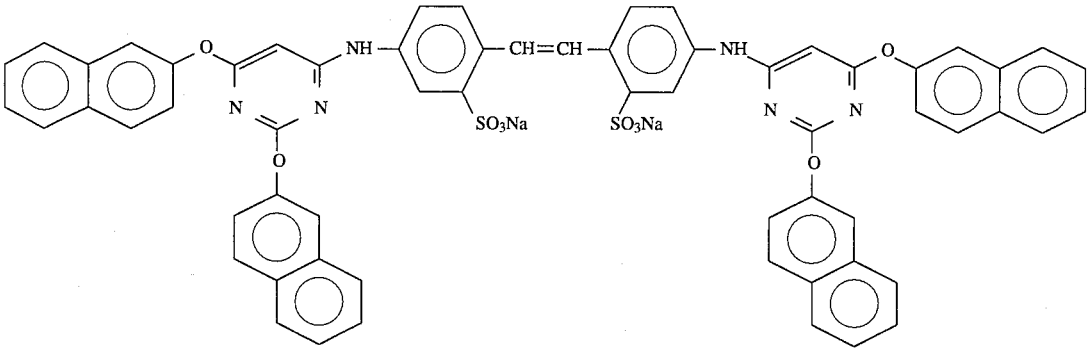

V-3

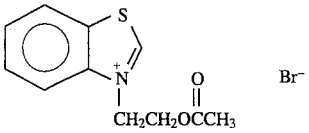

From the results in Table 4 above, it is understood that the sensitivity of the samples of the present invention hardly lowers even though they are stored under the indicated severe conditions. When compound (V-1) or (V-2) is incorporated into the sample along with the methine compound of formula (I) of the present invention, the decrease of the sensitivity of the sample under storage thereof in high-temperature and high-humidity conditions of 80% RH and 50° C. is reduced (Samples 2-3 and 2-7). With respect to Sample 2-11 containing compound (IV-1) along with the methine compound of formula (I) of the present invention, it is noted that the decrease of the sensitivity of Sample 2-11 under storage thereof in high-temperature and high-humidity conditions of 80% RH and 50° C. or in oxygen partial pressure of 10 atms is much smaller than that of the sensitivity of Sample 2-10 under the same conditions. The same result was also obtained when compound (V-3) was used in place of compound (V-2). The effect of such compounds may also be expressed with other polymethine dyes than the dyes of the present invention. Where such compounds are combined with the polymethine dyes of formula (I) of the present invention, the decrease of the sensitivity of photographic materials containing them may effectively be prevented under various severe storing conditions.

EXAMPLE 6

An aqueous solution containing one kg of $AgNO_3$ and an aqueous solution containing 161 g of KBr and 205 g of NaCl were simultaneously added to an aqueous solution containing 72 g of gelatin and 16 g of NaCl, both at a constant rate over a period of 32 minutes (Br=23 mol %).

During addition, rhodium chloride and $K_3IrCl_6$ were added to the reaction system each in an amount of $5\times10^{-7}$ mol/mol-Ag, over a period of 10 minutes of the former half time. Next, soluble salts were removed, and gelatin was added. Next, the emulsion was adjusted to have pH of 6.0 and pAg of 7.5, and chloroauric acid and sodium thiosulfate were added thereto for chemical sensitization at 60° C. The time of chemical sensitization was selected to be such that may give the highest sensitivity to the resulting emulsion. To the emulsion were added 4-hydroxy- 6-methyl-1,3,3a,7-tetrazaindene as a stabilizer, and phenoxyethanol as an antiseptic.

One kg of the emulsion thus prepared was weighed; and 110 ml of a 0.05% solution of a sensitizing dye of formula (I) as indicated in Table 5 below, 60 ml of a 0.5 methanol solution of (V-1), 35 ml of a 0.5% methanol solution of (V-2) and 42 ml of a 0.5% methanol solution of (IV-1) were added thereto. Then, 100 mg/m$^2$ of hydroquinone, 25% to gelatin binder of polyethyl acrylate latex (as plasticizer), and 85 mg/m$^2$ of 2-bis(vinylsulfonylacetamido)ethane (as hardening agent) were added thereto. The resulting composition was coated on a polyester support in an amount of 3.7 g/m$^2$ as Ag. The amount of gelatin coated was 2.0 g/m$^2$.

Over the emulsion layer thus coated, a protecting layer was coated, which comprised 0.8 g/m$^2$ of gelatin, 40 mg/m$^2$ of polymethyl methacrylate (as matting agent; having mean grain size of 2.5 μm), 30 mg/m$^2$ of colloidal silica (having mean grain size of 4 μm), 80 mg/m$^2$ of silicone oil, 80 mg/m$^2$ of sodium dodecylbenzenesulfonate (as coating aid), a surfactant of $C_8F_{17}SO_2N(C_3H_7)$—$CH_2COOK$, 150 mg/m$^2$ of polyethyl acrylate latex, and 6 mg/m$^2$ of 1,1'-bisulfobutyl-3,3,3',3'-tetramethyl-5,5'-disulfoindotricarbocyanine potassium salt.

The back surface of the polyester support was coated with a backing layer and a backing layer protecting layer, each having the composition described below:

| Backing Layer: | |
|---|---|
| Gelatin | 2.4 g/m$^2$ |
| Sodium Dodecylbenzenesulfonate | 60 mg/m$^2$ |
| Dye (2) | 80 mg/m$^2$ |
| Dye (3) | 30 mg/m$^2$ |
| 1,1'-Disulfobutyl-3,3,3'3'-tetramethyl-5,5'-disulfoindotricarbocyanine Potassium Salt | 80 mg/m$^2$ |
| 1,3-Divinylsulfonyl-2-propanol | 60 mg/m$^2$ |
| Potassium Polyvinylbenzenesulfonate | 30 mg/m$^2$ |
| **Backing Layer Protecting Layer:** | |
| Gelatin | 0.75 mg/m$^2$ |
| Polymethyl Methacrylate (mean grain size 3.5 μm) | 40 mg/m$^2$ |
| Sodium Dodecylbenzenesulfonate | 20 mg/m$^2$ |
| Surfactant $C_8F_{17}SO_2N(C_3H_7)$—$CH_2COOK$ | 2 mg/m$^2$ |
| Silicone Oil | 100 mg/m$^2$ |

Dyes (2) and (3) used above are mentioned below.

Dye (2):

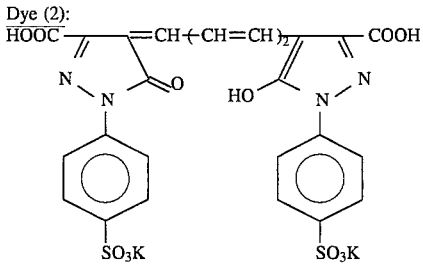

Dye (3):

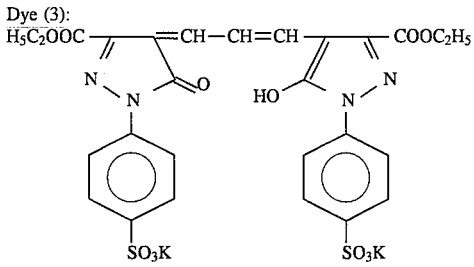

The samples thus prepared were divided into three groups. The first group was stored at −30° C. for one year, and the second group was stored under atmospheric condition for one year. The third group was stored at −30° C. for one year but under the conditions of 80% RH and 50° C. for the last three days before exposure. All of them were sensitometrically exposed by scanning exposure with a semiconductor laser of emitting a light of 780 nm; and they were developed at 38° C. for 14 seconds, then fixed, rinsed in water and dried with an automatic developing machine (FG-310PTS Model, manufactured by Fuji Photo Film Co.), using a developer and a fixer described below.

The sensitivity of each sample was determined as the reciprocal of the exposure amount of giving a density of 3.0. The results obtained are shown in Table 5 below, in which the sensitivity is represented by a relative value to the standard sensitivity (100) of each sample stored at −30° C.

| Composition of Developer: | |
|---|---|
| Water | 720 ml |
| Disodium Ethylenediaminetetraacetate | 4 g |
| Sodium Hydroxide | 44 g |
| Sodium Sulfite | 45 g |
| 2-Methylimidazole | 2 g |
| Sodium Carbonate | 26.4 g |
| Boric Acid | 1.6 g |
| Potassium Bromide | 1 g |
| Hydroquinone | 36 g |
| Diethylene Glycol | 39 g |
| 5-Methylbenzotriazole | 0.2 g |
| Pyrazolone | 0.7 g |
| Water to make | 1 liter |
| **Composition of Fixer:** | |
| Ammonium Thiosulfate | 170 g |
| Sodium Sulfite Anhydride | 15 g |
| Boric Acid | 7 g |
| Glacial Acetic Acid | 15 ml |
| Potassium Alum | 20 g |
| Ethylenediaminetetraacetic Acid | 0.1 g |
| Tartaric Acid | 3.5 g |
| Water to make | 1 liter |

TABLE 5

| Sample No. | Polymethine Dye Added: Compound | Polymethine Dye Added: Amount ($\times 10^{-5}$ mol/mol-Ag) | Stored at −30° C.: Sensitivity (standard) | Stored at −30° C.: Fog | Stored under 80% RH and 50° C. for 3 days: Relative Sensitivity | Stored under 80% RH and 50° C. for 3 days: Fog | Stored under atmospheric condition for one year: Relative Sensitivity | Stored under atmospheric condition for one year: Fog | Remarks |
|---|---|---|---|---|---|---|---|---|---|
| 6-1 | C-17 | 70 | 100 | 0.02 | 75 | 0.02 | 72 | 0.02 | comparative sample |
| 6-2 | C-18 | 70 | 100 | 0.02 | 74 | 0.02 | 65 | 0.02 | comparative sample |
| 6-3 | 34 | 70 | 100 | 0.02 | 93 | 0.02 | 90 | 0.02 | sample of the invention |
| 6-5 | C-19 | 1.0 | 100 | 0.02 | 65 | 0.04 | 54 | 0.03 | comparative sample |
| 6-5 | C-20 | 1.0 | 100 | 0.02 | 79 | 0.03 | 64 | 0.02 | comparative sample |
| 6-6 | 32 | 1.0 | 100 | 0.02 | 93 | 0.02 | 86 | 0.02 | sample of the invention |
| 6-7 | 33 | 1.0 | 100 | 0.02 | 98 | 0.02 | 81 | 0.02 | sample of the invention |

The comparative compounds used above are shown below:

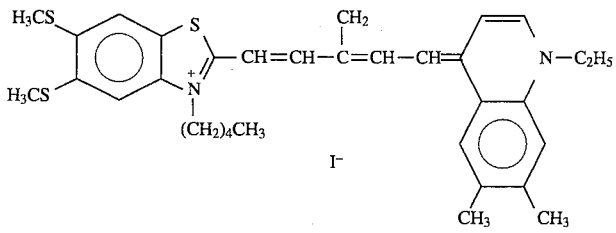

C-17

$E_{ox} = 0.42$

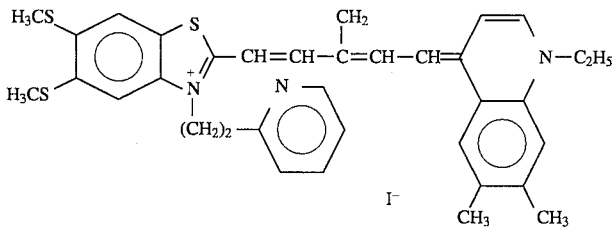

C-18

$E_{ox} = 0.415$

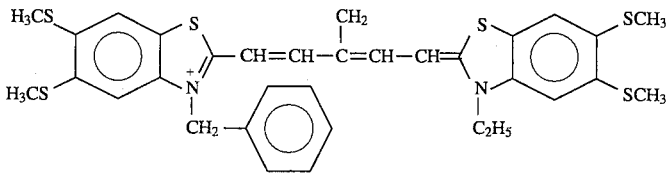

C-19

$E_{ox} = 0.254$

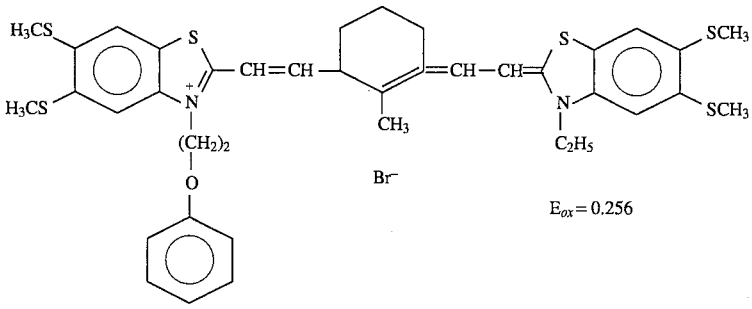

C-20

$E_{ox} = 0.256$

From the results in Table 5 above, it is noted that the sensitizing dyes of the present invention have a high storage stability.

As have been explained in detail above, the dyes of formula (I) of the present invention each have a high sensitivity and are extremely stable even when they are stored under severe conditions. Hitherto, conventional infrared-sensitizing dyes are extremely unstable so that commercial infrared silver halide photographic materials must be stored under a low temperature condition, for example, in a refrigerator or the like. Therefore, elevation of the stability of infrared-sensitizing dyes has been desired, and various trials and attempts combining the dyes with other various compounds so as to improve their stability have been made. The present invention is extremely meaningful and significant, giving stable infrared-sensitizing dyes of formula (I).

While the invention has been described in detail and with reference to specific embodiments thereof, it will be apparent to one skilled in the art that various changes and modifications can be made therein without departing from the spirit and scope thereof.

What is claimed is:

1. A silver halide emulsion containing at least one methine compound of general formula (I):

$$(MET)_{k1}—[(Q)—Ar]_{k2} \quad (I)$$

wherein

Q represents a divalent linking group composed of one or more than one atoms or one or more than one atomic groups containing at least one carbon, nitrogen, sulfur or oxygen atom;

Ar represents an aromatic group containing one monocyclic compound each composed of 5 or more atoms;

k1 represents an integer of 1; and k2 represents an integer of 2 or more;

wherein the methine compound of formula (I) has an oxidation potential of 0.60 (VvsSCE) or less;

and wherein MET in formula (I) represents an atomic group which has a hexamethine-merocyanine structure of general formula (II) or a heptamethine-cyanine structure of general formula (III):

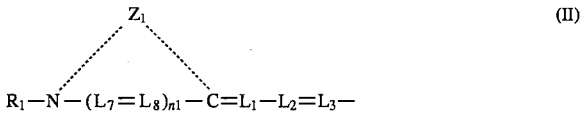

$$R_1—N—(L_7=L_8)_{n1}—C=L_1—L_2=L_3— \quad (II)$$

$$(M_1)_{m1}$$

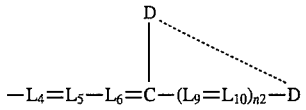

$$—L_4=L_5—L_6=C—(L_9=L_{10})_{n2}—D \quad (III)$$

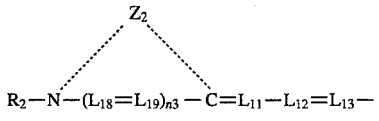

$$R_2—N—(L_{18}=L_{19})_{n3}—C=L_{11}—L_{12}=L_{13}—$$

$$(M_2)_{m2}$$

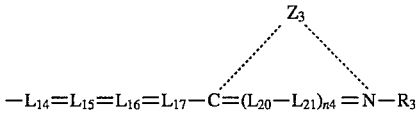

$$—L_{14}=L_{15}=L_{16}=L_{17}—C=(L_{20}—L_{21})_{n4}=N—R_3$$

wherein $Z_1$, $Z_2$ and $Z_3$ each represents an atomic group necessary for forming a 5-membered or 6-membered nitrogen-containing hetero ring;

the dotted line between D and D' groups may or may not indicate that those groups are linked;

D and D' each represents an atomic group necessary for forming a non-cyclic or cyclic acidic nucleus;

$R_1$, $R_2$ and $R_3$ each represents an alkyl group, wherein the substituent —(Q)—Ar groups are substituted onto any of $R_1$, $R_2$ and $R_3$ or on the nitrogen atoms in the acidic nucleus of D or D';

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$ and $L_{21}$ each represents a methine group or a substituted methine group, wherein at least one combination of $L_2$ and $L_4$, $L_3$ and $L_5$, and $L_4$ and $L_6$ forms a ring and wherein at least one combination of $L_{12}$ and $L_{14}$, $L_{13}$ and $L_{15}$, and $L_{14}$ and $L_{16}$ forms a ring;

$n_1$, $n_2$, $n_3$ and $n_4$ each represents 0 or 1;

$M_1$ and $M_2$ each represents a charge-neutralizing pair ion; and $m_1$ and $m_z$ each represents a number of 0 or more which is necessary for neutralizing the charge in the atomic group.

2. The silver halide emulsion as claimed in claim 1, wherein the atomic group of MET in formula (I) has a hexamethinemerocyanine structure of general formula (II).

3. The silver halide emulsion as claimed in claim 1, wherein the atomic group of MET in formula (I) has a heptamethine-cyanine structure of general formula (III).

4. The silver halide emulsion as claimed in claim 1, wherein $L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$ or $L_{21}$ represents a substituted methine containing a substituent selected from the group consisting of an alkyl group, an aryl group, a heterocyclic group, a halogen atom, an alkoxy group, an amino group and an alkylthio group.

5. The silver halide emulsion as claimed in claim 4, wherein $L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$ or $L_{21}$ represents a substituted methine group containing a substituent selected from the group consisting of a methyl group, an ethyl group, a 2-carboxyethyl group, a phenyl group, an o-carboxyphenyl group, a barbituric acid group, a chlorine atom, a bromine atom, a methoxy group, an ethoxy group, an N,N-diphenylamino group, an N-methyl-N-phenyl-amino group, an N-methylpiperazino group, a methylthio group and an ethylthio group.

6. The silver halide emulsion as claimed in claim 1, wherein one of $L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$ or $L_{21}$ forms a ring together with one or more than one methine group or forms a ring together with one or more than one auxochrome.

7. A silver halide photographic material comprising a support having provided thereon at least one silver halide emulsion layer, said at least one silver halide emulsion layer containing at least one methine compound of general formula (I):

$$(MET)_{k1}—[(Q)—Ar]_{k2} \quad (I)$$

Q represents a divalent linking group composed of one or more than one atoms or one or more than one atomic groups containing at least one carbon, nitrogen, sulfur or oxygen atom;

Ar represents an aromatic group containing one monocyclic compound each composed of 5 or more atoms;

k1 represents an integer of 1; and k2 represents an integer of 2 or more;

wherein the methine compound of formula (I) has an oxidation potential of 0.60 (VvsSCE) or less;

and wherein MET in formula (I) represents an atomic group which has a hexamethine-merocyanine structure of general formula (II) or a heptamethine-cyanine structure of general formula (III):

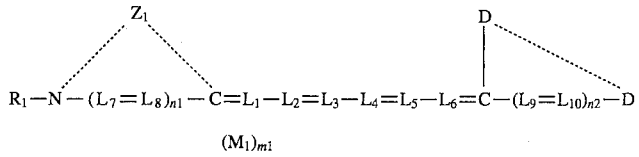

(II)

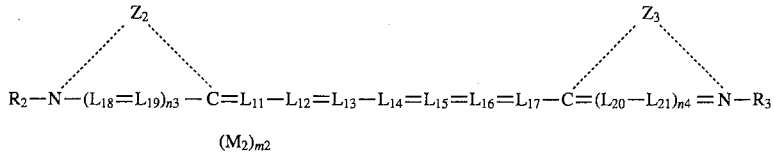

(III)

wherein $Z_1$, $Z_2$ and $Z_3$ each represents an atomic group necessary for forming a 5-membered or 6-membered nitrogen-containing hetero ring;

the dotted line between D and D' groups may or may not indicate that those groups are linked;

D and D' each represents an atomic group necessary for forming a non-cyclic or cyclic acidic nucleus;

$R_1$, $R_2$ and $R_3$ each represents an alkyl group, wherein the substituent —(Q)—Ar groups are substituted onto any of $R_1$, $R_2$ and $R_3$ or on the nitrogen atoms in the acidic nucleus of D or D'; $L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$ and $L_{21}$ each represents a methine group or a substituted methine group, wherein at least one combination of $L_2$ and $L_4$, $L_3$ and $L_5$, and $L_4$ and $L_6$ forms a ring and wherein at least one combination of $L_{12}$ and $L_{14}$, $L_{13}$ and $L_{15}$, and $L_{14}$ and $L_{16}$ forms a ring;

$n_1$, $n_2$, $n_3$ and $n_4$ each represents 0 or 1;

$M_1$ and $M_2$ each represents a charge-neutralizing pair ion; and $m_1$ and $m_2$ each represents a number of 0 or more which is necessary for neutralizing the charge in the atomic group.

8. The silver halide photographic material as claimed in claim 7, wherein the atomic group of MET in formula (I) has a hexamethine-merocyanine structure of general formula (II).

9. The silver halide photographic material as claimed in claim 7, wherein the atomic group of MET in formula (I) has a heptamethine-cyanine structure of general formula (III).

10. The silver halide photographic material as claimed in claim 7, wherein $L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$ or $L_{21}$ represents a substituted methine containing a substituent selected from the group consisting of an alkyl group, an aryl group, a heterocyclic group, a halogen atom, an alkoxy group, an amino group and an alkylthio group.

11. The silver halide photographic material as claimed in claim 10, wherein $L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$ or $L_{21}$ represents a substituted methine group containing a substituent selected from the group consisting of a methyl group, an ethyl group, a 2 -carboxyethyl group, a phenyl group, an o-carboxyphenyl group, a barbituric acid group, a chlorine atom, a bromine atom, a methoxy group, an ethoxy group, an N, N-diphenylamino group, an N-methyl-N-phenyl-amino group, an N-methylpiperazino group, a methylthio group and an ethylthio group.

12. The silver halide photographic material as claimed in claim 7, wherein one of $L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$ or $L_{21}$ forms a ring together with one or more than one methine group or forms a ring together with one or more than one auxochrome.

* * * * *